US005669865A

United States Patent [19]

Gordon

[11] Patent Number: 5,669,865

[45] Date of Patent: Sep. 23, 1997

[54] BODY FOLD AND EXTENSION EXERCISE APPARATUS

[76] Inventor: Trace O. Gordon, 3880 W. Lariat Rd., Park City, Utah 84098

[21] Appl. No.: 604,857

[22] Filed: Feb. 22, 1996

[51] Int. Cl.[6] ..... A63B 26/00

[52] U.S. Cl. ..... 482/142; 482/145; 482/96

[58] Field of Search ..... 482/55, 96, 130, 482/142, 145, 137

[56] References Cited

U.S. PATENT DOCUMENTS

| | | | |
|---|---|---|---|
| 3,716,230 | 2/1973 | Mark | 482/142 |
| 3,787,190 | 1/1974 | Biggerstaff | 482/142 |
| 4,341,378 | 7/1982 | Agvagos | 482/142 |
| 4,387,893 | 6/1983 | Baldwin | 482/137 |
| 5,100,131 | 3/1992 | Fong | 482/137 |
| 5,230,680 | 7/1993 | Wu | 482/137 |

*Primary Examiner*—Lynne A. Reichard

*Attorney, Agent, or Firm*—Thorpe North & Western, L.L.P.

[57] ABSTRACT

A fold/extension exercise apparatus is disclosed including a support frame with a seating device pivotably attached thereto. Attached to the support frame and to the seating device may be one or more elongate pull-up/press bars with a handle formed therein or some other mechanism for exercising the arms. A leg curl/extension mechanism may also be provided and disposed so that extension of the leg curl mechanism causes extension of the seating device. Each of the respective portions of the exercise apparatus have extended positions and folded positions as to enable the user to simultaneously work the arms, legs and abdomen.

70 Claims, 11 Drawing Sheets

BODY FOLD AND EXTENSION EXERCISE APPARATUS

BACKGROUND OF THE INVENTION

1. Subject Matter of the Invention

The present invention relates to an exercise apparatus which moves between folded and extended positions. More particularly, the present invention relates to an exercise apparatus which allows the user to use all of the major muscle groups of the body as he or she moves between folded and extended positions.

2. State of the Art

The use of exercise equipment to build strength, endurance, or simply to improve one's health has gained immense popularity in recent years. Numerous different pieces of exercise equipment have been developed to work different muscle groups of the body. One recent trend has been exercise equipment which is designed to increase aerobic conditioning by working the large muscle groups.

Unfortunately, while many of these machines provide good workouts for the biceps and triceps of the arms, the deltoids in the shoulders and the quadriceps of the legs, they often provide too light of a workout, if any, for other muscle groups, such as the abdominal muscles, the pectoral muscles, the muscles of the lower back, and the hamstrings in the legs.

The failure to adequately work these other muscle groups raises several concerns. For example, hamstring injuries are common in many sports and take a considerable amount of recovery time—time during which the injured person must limit any workouts involving the legs.

For many men, the failure to work the abdominal muscles results in an unattractive physique and, in conjunction with failure to work the muscles of the lower back, results in chronic back problems. These back problems interfere with exercise, work, and most other activities.

To overcome these concerns, many fitness minded people use exercise machines which exercise the abdominal groups, the hamstrings, and the other muscle groups which are not used sufficiently with popular exercise equipment. Unfortunately, many cannot afford the time or money necessary to routinely go to a gymnasium which has all of the machines necessary to perform such exercises. Additionally, such machines are often impractical, as many users desire to exercise in their homes. However, most homes do not have sufficient free space for a stomach crunch machine, a weight bench and a machine for performing leg extensions and curls, in addition to the space occupied by the machines used for aerobic workouts.

Thus, there is needed an exercise apparatus which allows the user to exercise not only the large muscle groups of the arms and legs, but also those muscle groups, such as the abdominal muscles, which are often neglected. Such a machine should desirably allow the user to concurrently exercise the abdominal and other muscle groups, so as to achieve maximum efficiency while exercising.

SUMMARY OF THE INVENTION

Thus, it is an object of the present invention to provide an exercise apparatus which enables the user to exercise all of the major muscle groups during the same workout.

It is another object of the present invention to provide such an exercise apparatus which is inexpensive and easy to use.

It is still another object of the present invention to provide such an exercise apparatus which is relatively compact to enable easy storage when not in use.

It is yet another object of the present invention to provide such an exercise apparatus which is relatively light weight and easy to move.

It is still yet another object of the present invention to provide such an exercise apparatus which is adjustable to accommodate users of differing heights, and those desiring workouts of different intensities.

The above and other objects of the invention are realized in specific illustrative embodiments of a body fold and extension (hereinafter "fold/extension exercise apparatus") having a support frame with a movable seat member attached thereto. The seat has upper and lower portions for supporting the back and buttocks, respectively, of the user. The seat is disposed with respect to the support frame so as to be movable between a first, extended position wherein the upper portion is generally horizontal or non-vertical, and a second, folded position wherein the upper portion is generally vertical.

In accordance with one aspect of the present invention, the seat contains a pivot axis which allows the user to pull opposing ends of the upper and lower sections together to perform an abdominal curl or crunch, and to force the opposing ends of the upper and lower portions away from one another by flexing the muscles of the back so that the torso assumes an extended position.

In accordance with another aspect of the invention, a leg curl and extension apparatus (hereinafter "curl/extension apparatus") is attached to the seat so that a user simultaneously works the abdominal area and the legs. The curl/extension apparatus is disposed so that a user will typically perform a leg curl at the same time an abdominal curl is being performed. Of course, the leg curl/extension apparatus could be attached to enable a user to perform leg extensions while performing an abdominal curl, and leg curls while performing a back flex and abdominal extension. The attachment is made so that the pivoting seat and the leg curl/extension device function together to maximize the workout achieved.

In accordance with another aspect of the invention, the leg curl/extension apparatus is fixedly attached to the frame, and the pivotable seat member moves toward and away from the leg curl/extension apparatus as it moves between folded and extended positions so that extensions and curls of the legs moves the pivotable seat member between folded and extended positions. The seat member is typically integrated so that the user performs a leg extension or curl at the same time as he or she performs a torso extension or curl.

In accordance with another aspect of the invention, one or more pull-up and press bars (hereinafter "pull-up/press bars") are attached to the support frame and the seat so that the bar may be pulled down during an abdominal curl, thereby simulating a pull-up, or pushed upwardly during an abdominal extension to simulate a bench press or military press. In one embodiment, the seat and pull-up/press bar interact so that the user of the apparatus uses his or her arms and abdomen at the same time. In another embodiment, the pull-up press bar acts independently of the pivotable seat member so that either may be used without the other.

Another aspect of the present invention involves the use of pull cables to draw the pivotable seat member into an extended position. When force on the pull-cables is released, the pivotable seat member returns to the folded position. This may be either due to the seat members own weight, or that of the user. By modifying the direction which the pull cables are pulled, the user can simulate different arm exercises.

In accordance with yet another aspect of the invention, a resistance device, such as a piston or spring, is attached to the support frame and to the seat or some other portion of the exercise apparatus to provide resistance in addition to the user's body weight. The resistance device may be varied to provide different intensity workouts or to permit warm-up and cool down periods.

In accordance with still another aspect of the invention, a support handle is provided for facilitating entry into and exit from the exercise apparatus. In addition to assisting entry and exit, the support handle can be used to simulate dips and curls with the arms, thereby working a different combination of muscles than with a pull-up or press. The support handle is adjustable to conform to users of different heights, and to enable the user to select different levels of difficulty when performing dips and curls.

Still yet another aspect of the invention involves a pivotable attachment between a support holding the seat and the support frame. The attachment can be locked into place to exercise the muscles, or can be loosened so that the support and the support frame provide a different orientation, thereby working the muscles differently. Thus, the user can alter the movements of the exercise apparatus to follow the routine which is most comfortable or which provides the best workout for the particular body parts desired.

In use, the person sits in the seat, mounts his or her legs within the leg curl/extension apparatus and grasps the handles on the pull-up/press bars, the pulleys or some analogous structure. By extending his or her back, legs and arms, the user is moved into a first, extended position, simultaneously exercising the trapezius and latissimus muscles in the back, the triceps, the pectoralis group, the deltoids, the gluteus muscles and the quadriceps. By pulling the bar and the leg curl/extension apparatus inwardly, the user moves the exercise apparatus in a second, folded position and is able to simultaneously exercise the abdominal muscles, the biceps, and the hamstrings and calves in the legs. Thus, within a very short period of time, all of the major muscle groups are exercised.

In accordance with still another aspect of the present invention, the leg curl/extension apparatus is formed integrally with the support frame for the device. A rotatable seat member is disposed to pivot with respect to the frame such that the pivoting the seat member in one direction is achieved by extension of the legs and torso, while pivoting in the opposing direction is achieved by performing a leg curl and a crunch.

BRIEF DESCRIPTION OF THE DRAWINGS

The above and other objects, features and advantages of the invention will become apparent from a consideration of the following detailed description presented in connection with the accompanying drawings in which.

DETAILED DESCRIPTION

Reference will now be made to the drawings in which the various elements of the present invention will be given numeral designations and in which the invention will be discussed so as to enable one skilled in the art to make and use the invention. It is to be understood that the following description is only exemplary of the principles of the present invention, and should not be viewed as narrowing the pending claims.

Figure 1:
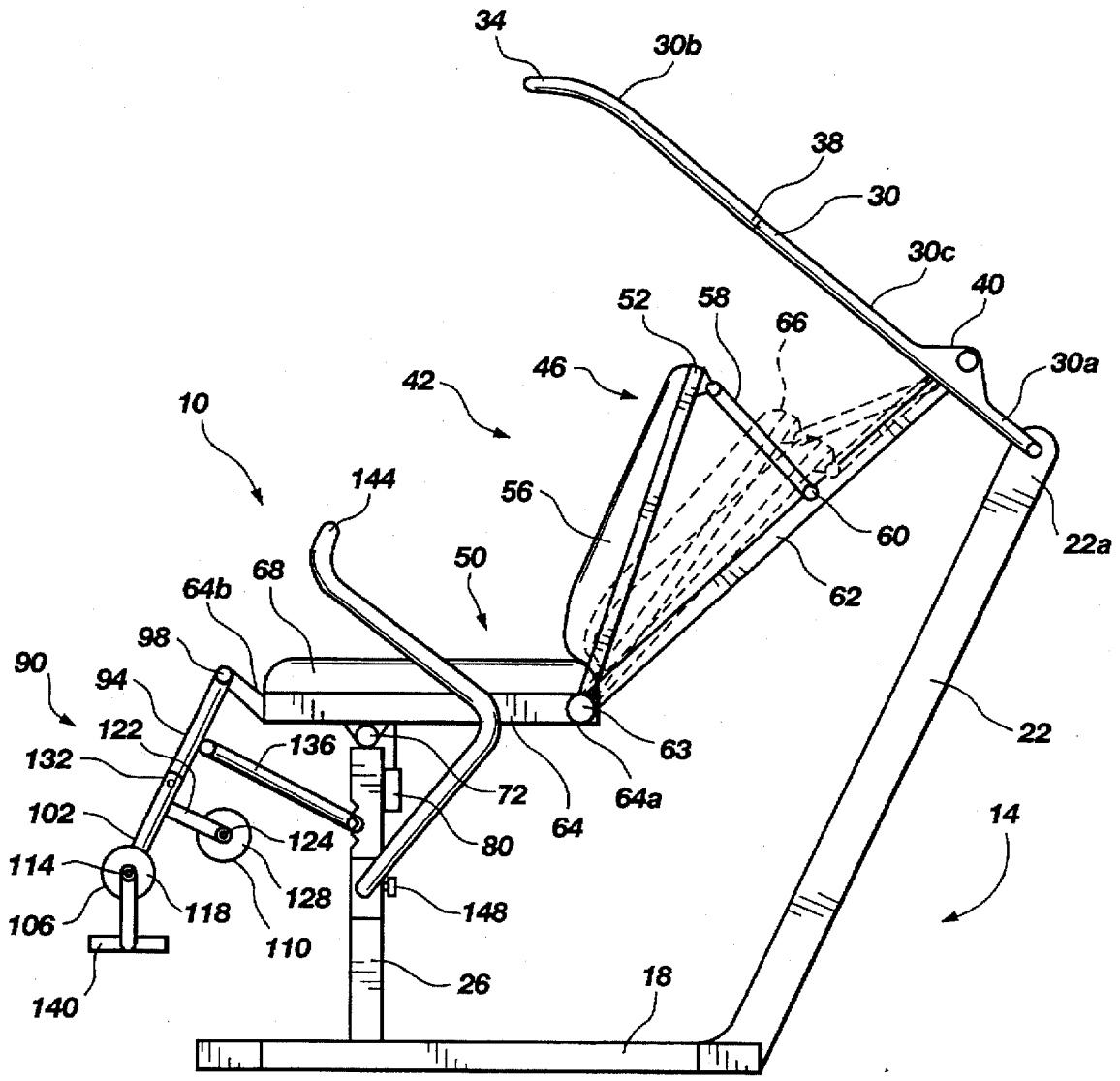
FIG. 1 shows a side view of a fold/extension exercise apparatus made in accordance with the principles of the present invention, the apparatus being in a neutral position, and person seated thereon.
Figure 3:
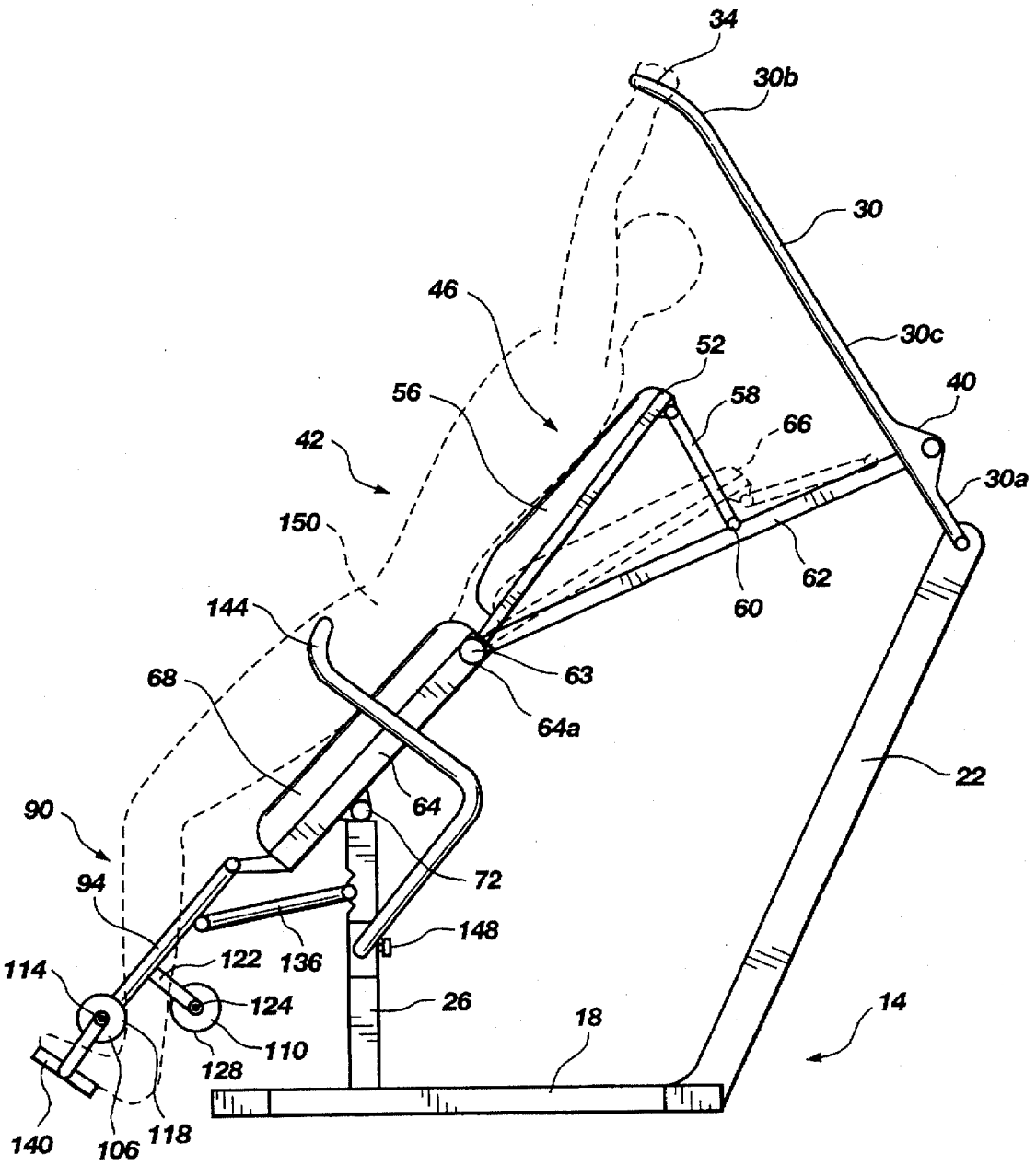
FIG. 3 shows a side view of the fold/extension exercise apparatus of FIG. 1, the apparatus being in a first, extended position.
Figure 4:
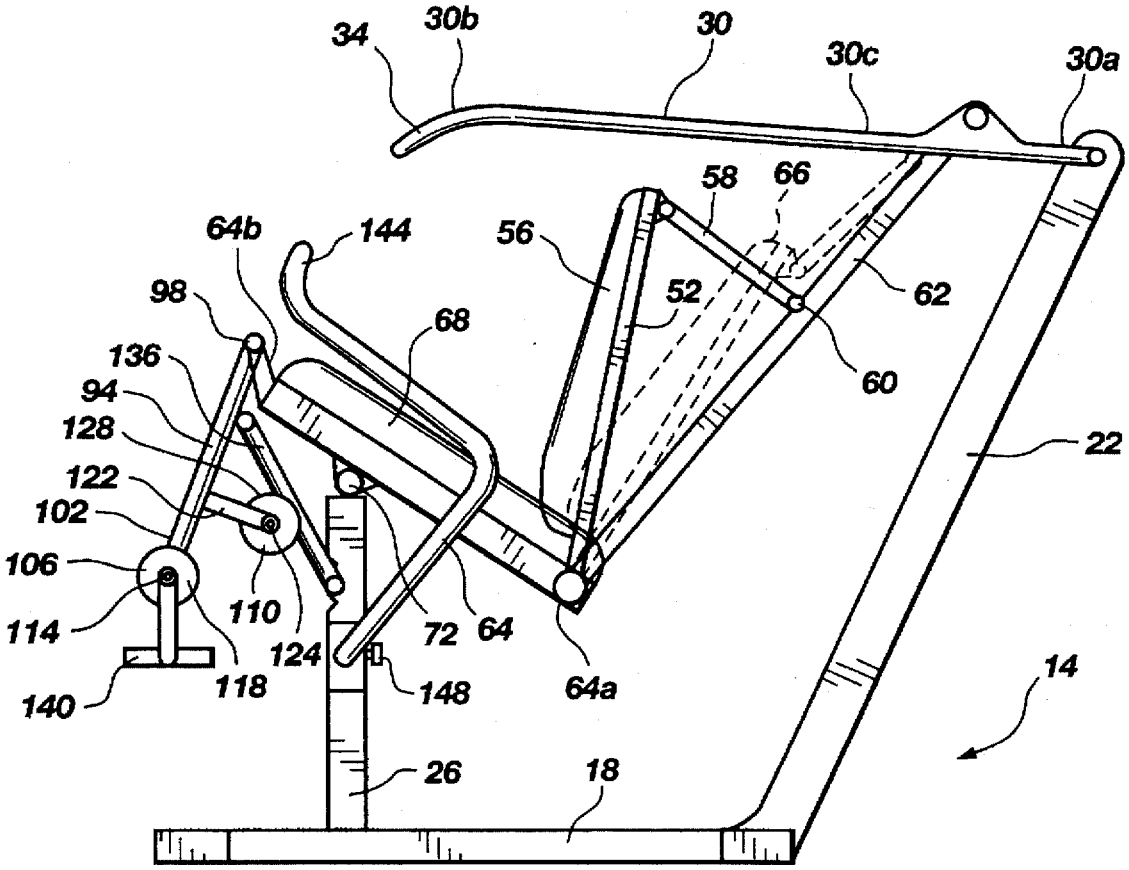
FIG. 4 shows a side view of the fold/extension exercise apparatus of FIG. 1, the apparatus being in a second, folded position.

Referring to FIG. 1, there is shown a side view of a body fold/extension exercise apparatus, generally indicated at 10, disposed in a neutral, starting position. As will be explained in detail below, the fold/extension exercise apparatus 10 is moveable between a first, extended position, as is shown in FIG. 3, and a second, folded position, as is shown in FIG. 4, so as to work all of the major muscle groups of a person using the exercise apparatus.

The exercise apparatus 10 includes a support frame, generally indicated at 14, with a generally horizontally disposed base portion 18 which rests on a flat surface such as a floor (not shown). The support frame 14 also includes at least one first, generally vertical support column 22, extending upwardly from the base portion near a rearward side thereof, and at least one second, generally vertical support column 26, also extending upwardly from the base portion adjacent a forward side thereof. Each component of the support frame 14 is typically made of tubular steel or some other material which is rigid, durable, lightweight and inexpensive. Tubular steel is preferred because it meets each of these requirements and has long been used for the formation of exercise equipment.

Attached to the first generally vertical support column 22 is one or more elongate pull-up/press bars 30. The elongate pull-up/press bar 30 is attached at a first end 30*a* to the upper end 22A of the first generally vertical support column 22. A second, free end 30*b* of the pull-up/press bar 30 forms a curved handle 34 which is positioned above a seating device (discussed below). As shown in FIG. 1, each elongate pull-up/press bar 30 may actually be formed of two elongate bars which are connected by an adjustment mechanism 38. The adjustment mechanism 38 allows the position of the handles 34 to be adjusted to compensate for users of various heights.

By moving the handles 34 (and thus the second, free end 30*b*) upwardly or downwardly between first and second positions, the pull-up/press bar 30 is forced to pivot in the same direction. The movement of the handles 34 thus simulates a pull-up or a bench press.

A plate 40 is connected to the pull-up/press bars 30, along a middle portion 30*c* thereof. A seating device, generally indicated at 42, is pivotably attached to the plate so as to pivot or rotate relative thereto when the pull-up/press bar 30 is moved up or down.

The seating device 42 includes an upper portion, generally indicated at 46, and a lower portion, generally indicated at 50. The upper portion 46 includes a back rest frame 52 which typically has padding 56 attached thereto. One or more attachment arms 58 extend rearwardly to an adjustable attachment 60 with a brace 62 used to connect a pivot point 63 of the seating device 42 to the pull-up/press bar 30.

The adjustable attachment 60 of the attachment arm(s) 58 allows the position of the upper portion 46 of the seating device 42 to be varied relative to the brace 62, as represented by the dashed figures 66. Such a position allows modifications to adapt to the height of the user, and also allows the exercise apparatus 10 to be modified. For example, when the upper portion 46 of the seating device 42 is positioned adjacent to the brace 62, considerably more rearward extension can be achieved. The additional extension provides an improved workout for the muscles of the back and helps to increase flexibility of the spine. Likewise, in this position the upper portion 46 provides less support to the user when performing an abdominal crunch. Thus, the user must work harder to complete each crunch.

The lower portion 50 of the seating device 42 includes a seat frame 64 which typically has padding 68 attached thereto. The seat frame 64 has a rotatable attachment member 72 which enables the seat frame to be rotatably attached to the second generally vertical support column 26. The attachment member 72 may be a hinge or any other pivotable attachment mechanism which allows the ends 64*a* and 64*b* of the seat frame 64 to pivot with respect to the second generally vertical support column 26. Those skilled in the art will be familiar with numerous methods for attaching the attachment member 72 both to the seat frame 64 and the support column 26.

A resistance means 80 may be attached to the second generally vertical support column 26 and to the seat frame 64 so as to resist movement (pivoting) of the seat frame relative to the support column. As shown in FIG. 1, the resistance means 80 is in the form of a shock absorber or linear decelerator. However, those skilled in the art will appreciate that springs or numerous other mechanisms could be used to provide resistance. Preferably, resistance will be provided in both directions. Additionally, the resistance means 80 may be variable to adjust the resistance to the level desired by the user. By allowing adjustability, the resistance means 80 allows the exercise apparatus to be used by people with different fitness levels, and allows all users to warm-up and cool down at light workout settings, while obtaining heavy workouts when desired.

Attached to the end 64*b* of the seat frame 64 opposite the upper portion 46 is a leg curl/extension apparatus, generally indicated at 90. The leg curl/extension apparatus 90 includes a frame 94 which is attached at a first end 98 to the lower end 64*b* of the seat frame 64 in a pivotable arrangement to allow the leg curl/extension apparatus to move relative to the seat frame while the fold/extension exercise apparatus 10 is in use.

On a second end 102 of the leg curl/extension frame 94, opposite the first end 98, are a pair of leg supports 106 and 110, respectively. A first, forward leg support 106 is positioned at the bottom of the frame 94. A small tubular flange 114 extends outwardly from the frame on each side (only one of which is shown in FIG. 1). A resilient material 118, such as foam, is disposed about the tubular flange 114 to protect the legs of the user from bruising by the flange. Such resilient coverings are well known in the art, as they are commonly used on leg curl/extension machines.

Slightly above the bottom of the frame 94, a support bar 122 extends rearwardly to a tubular flange 124 about which a resilient material 128 is placed to form the second, rearward leg support 110. In use, a person places his or her legs so that they are positioned between the first, forward leg support 106 and the second, rearward support 110. Typically, the user will position his or her legs so that the leg supports, 106 and 110 respectively, will be positioned adjacent the ankles or part way up the calves. The frame 94 could be made of two pieces to provide an adjustment means 132 to lengthen or shorten the frame to accommodate the anatomy of the particular user.

The frame 94 is attached to the second generally vertical support column 26 by an attachment rod 136. The attachment rod 136 is attached to both the frame 94 and the second generally vertical support column 26 by pivotable attachments. As the seat frame 64 is moved so that the lower end 64*b* pivots upwardly, the attachment bar 136 draws the frame 94 somewhat rearwardly. Likewise, when the lower end 102 of the frame 94 is forced toward the second generally vertical support column 26, the attachment bar 136 forces the upper end 98 upwardly, so the leg curl/extension apparatus 90 has moved from a first, extended position to a second, folded position. This change causes the "lower" end 64*b* of the seat frame 64 to move generally upwardly, and the opposing end 64*a* to move downwardly. Thus, as a user performs a leg curl and abdominal curl, the position of the leg curl/extension apparatus 90 is moved, as is the position of the seat device 42.

Extending from the frame 94 is a foot rest 140. The foot rest 140 may be used by a person getting onto or off of the exercise apparatus 10 to steady himself or herself. Additionally, the foot rest 140 may be used to perform a leg press instead of a conventional leg extension when moving into the extended position. Those familiar with exercise physiology will appreciate that a leg press works the muscles of the leg in a different manner than a conventional leg extension. Thus, by performing leg curls, extensions, and presses, the user can maximize the workout for all of the muscles in the leg.

Also shown in FIG. 1 is a lower bracing handle 144 which is used to support the user when getting into or out of the device. The bracing handle 144 will typically be curved to provide easy gripping and can be used with the other features of the exercise apparatus to provide an improved workout for the user. For example, a common exercise to isolate and work muscle groups in the arms is an arm supported exercise commonly referred to as a dip. Another common exercise is an arm curl. By using the bracing handle 144 instead of the pull-up/press bar 30, the user can simulate dips and curls while performing abdominal crunches and/or leg curls and extensions (or leg presses). An adjustment knob 148 can be provided to allow adjustment of the position of the bracing handles 144 to facilitate ease of entry for users of different heights, and to change the intensity of dips and curls performed with the handles. Thus, the exercise apparatus 10 allows the user to perform numerous different exercises without moving from the apparatus.

Figure 2:
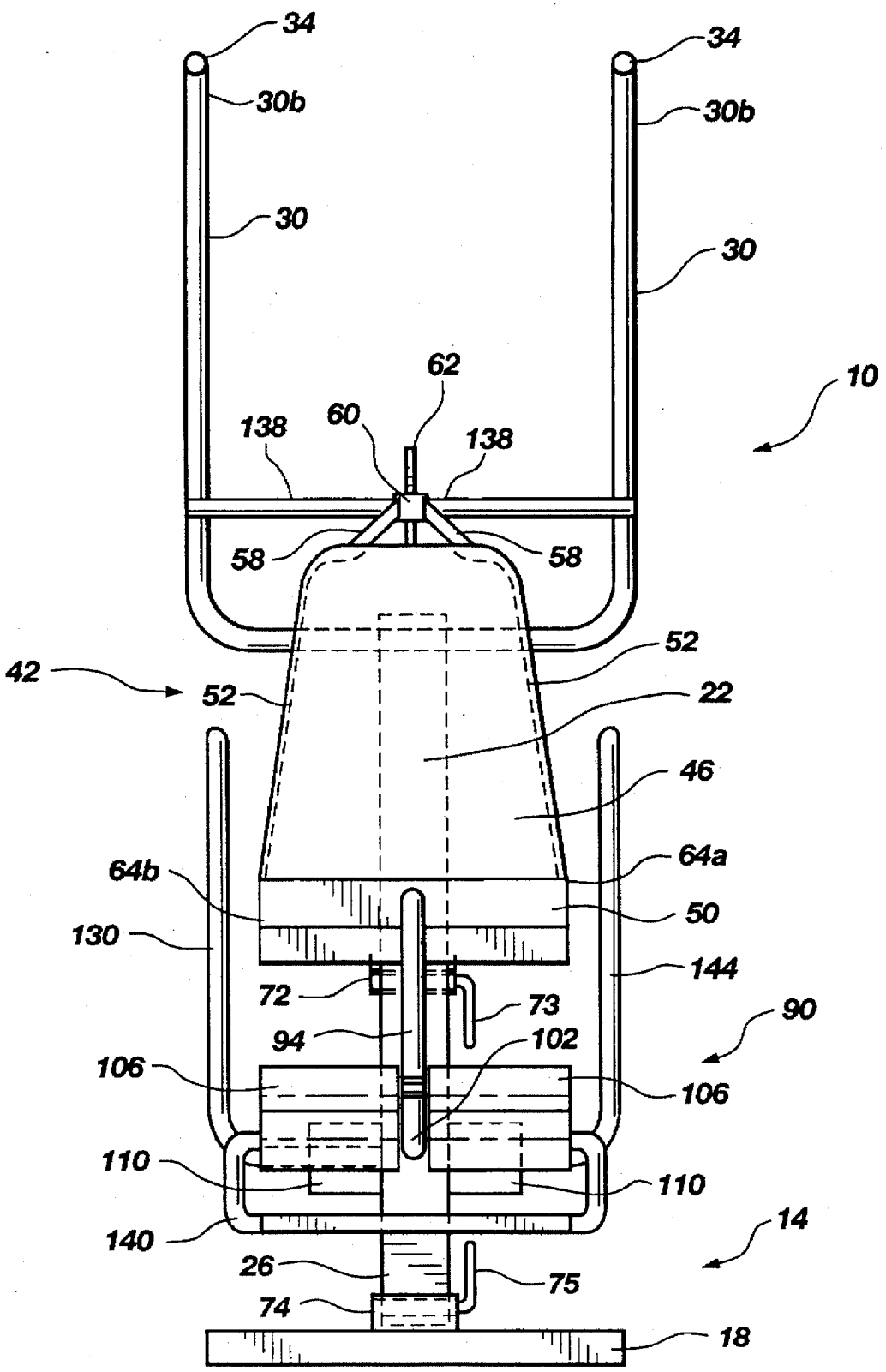
FIG. 2 shows a front view of the fold/extension exercise apparatus show in FIG. 1 in a neutral position.

Referring now to FIG. 2, there is shown a front, perspective view of the fold/extension exercise apparatus 10 shown in FIG. 1. As shown in FIG. 2, the apparatus 10 includes the support frame, generally indicated at 14, with the generally horizontally disposed base portion 18. FIG. 2 shows the first, generally vertical support column 22 (shadowed by the upper portion 46 of the seat device 42), extending upwardly from the base portion 18 and the second, generally vertical support column 26, also extending upwardly from the base portion 18.

Attached to the first, generally vertical support column 22 is a pair of elongate pull-up/press bars 30. The elongate pull-up/press bars 30 are attached in a pivotable attachment, independent of any attachment of the support frame 14, to the seating device 42 or the leg curl/extension apparatus 90 so that the second ends **30*b* and the handles 34 attached thereto can be moved toward and away from the seating device. The upper portion 46 of the seating device 42 is attached to the pull-up/press bars 30 by the arms 58 which are attached to the brace 62. As shown in FIG. 2, the arms 58 are attached to the brace 62 adjacent the attachment of the brace 62 to a pivoting attachment bar 138 which connects the brace to the pull-up/press arms 30**.

The pivotable attachment bar 138 between the arms 60 and the pull-up/press bars 30 allows the handles 34 to be pulled down adjacent the lap of a user when an abdominal curl is being performed in the seat device 42, and pushed away from the user when the user is extending. With the embodiment shown, pushing upwardly on the handles 34 facilitates movement of the seat device 42 into the extension position shown in FIG. 3, and pulling downwardly on the handles 34 facilitates movement of the seat device 42 into a position assumed when the user is performing an abdominal curl, as is shown in FIG. 4.

Due to the pivotal attachment to the lower portion 50 of the seating device 42 and the brace 62 (FIG. 1), the upper portion 46 of the seating device 42 is able to move downwardly when the handles 34 are pulled downwardly and upwardly when the handles are pushed upwardly due to the pivoting nature of the lower portion 50 with respect to the second generally vertical support columns 26. As the lower portion 50 pivots rearwardly, the end **64*a* (FIGS. 1, 2 and 3) to which the upper portion 46 is attached moves downwardly. When the lower portion 50 has pivoted into a position in which it slopes generally rearwardly, as is shown in FIG. 3, the user is in a position in which he or she is performing an abdominal curl—i.e. the abdominal muscles are tightened to maintain the position. This cooperative functioning between the pull-up/press bars 30 and handles 34, and the seating device 42** allows all of the major muscles of the arms and torso to be worked together by moving the apparatus between the first, extended position and the second, folded position, and vice-versa.

As the arms and torso are being worked, the leg curl/extension apparatus 90 allows the legs to be worked. In FIGS. 1 and 2, the leg curl/extension apparatus 90 is in a neutral position. As the handles 34 are pushed out and the seating device 42 is moved into the extended position, the quadriceps of the user's legs assist by moving the leg curl/extension apparatus 90 into the extended position (FIG. 3), thereby pulling down the lower end **64*b* of the seat frame 64, and moving the seating device 42** into the extended position.

The force on the lower end **64*b* of the seat frame 64 created by movement of the frame 94 of the leg curl/extension apparatus 90 results from the attachment bar 136 (FIG. 1) which keeps the frame 94 of the leg curl/extension apparatus 90 at a distance from the second generally vertical support column 26. Because the frame 94 of the leg curl/extension apparatus 94 is limited in movement by the attachment bar 136 (FIGS. 1, 3 and 4), rearward force, i.e. force toward the second generally vertical support column 26, moves the frame upwardly. Likewise, forward force moves the frame 94 and the lower end 64*b* of the seat frame 64 downwardly. Those skilled in the art will appreciate that the independent attachments of the seating device 42, the pull-up/press bars 30 and leg curl/extension apparatus 90**, i.e. each being directly attached to the support frame independent of the others, allow the unique interaction disclosed herein.

Also shown in FIG. 2 are pivotable attachment members 72 and 74. The pivotable attachment member 72 connects the lower portion 50 of the seating device 42 to the second generally vertical support column 26 to allow the lower portion to pivot with respect to the support column. As the apparatus 10 is moved between the extended position shown in FIG. 2 and the folded position shown in FIG. 3, the end **64*b* of the lower portion 50 attached to the leg extension apparatus 90** will move from a position generally pivotable attachment to a position generally above the attachment.

Disposed at the lower end 102 of the frame 94 of the leg curl/extension apparatus 90 is the foot rest 140. The foot rest 140 facilitates entry onto the exercise apparatus 10, and enables the leg curl/extension apparatus 90 to be used for leg presses as well.

Also shown in FIG. 2 is a handle 73 which can be used to selectively lock the pivotable attachment 72, thereby preventing movement between the second generally vertical support column 26 and the lower portion 50 of the seating device 42. When the handle 73 is moved into a locking position wherein it prevents such pivoting between the lower portion 50 of the seating device 42 and the second support column 26, the handle 75 connected to the pivotable attachment 74 at the bottom of the second support column will generally be moved into an unlocking position to allow the support column to move with the lower portion 50 of the seating device. This is particularly helpful when compacting the fold/extension exercise apparatus 10 so that it may be conveniently stored as is discussed in detail with respect to FIG. 5.

Referring now to FIG. 3, there is shown a side view of the exercise apparatus 10 in a first, extended position. The handle 34 at the end **30*b* of the pull-up/press bar 30 is pushed away from the seating device 42 so that the pull-up press bar extends in a more vertical direction than that shown in FIG. 1. As the pull-up/press bar 30 moves into a more vertical orientation, the brace 62 which is attached to the bar (via the plate 40**) moves rearwardly and into a more horizontal position.

As the brace 62 moves rearwardly, it raises the pivot point 63 between the upper portion 46 and lower portion 50 of the seating device 42. The movement of the brace 62 also causes the upper portion 46 of the seating device 42 to move rearwardly and into a slightly more horizontal position. As is demonstrated by the different positions between the upper portion 46 and the dashed figure 66, the position of the upper portion of the seating device 42 depends on the point of attachment between the arm 58 and the brace 62. The higher the point of attachment 60, the further reclined the upper portion 46 will generally be when the exercise apparatus 10 is in the first, extended position.

The adjustability of the upper portion 46 of the seating device 42 serves two major purposes. First, the adjustability allows users of different sizes to find a comfortable position for the upper portion 46 throughout the range of motion for the exercise apparatus. Second, the adjustability allows the user to control the difficulty of the workout. When the upper portion 46 of the seating device 42 is positioned rearwardly, as shown by dashed figure 66, less support is provided for the back of the user, and the point to which the user must extend his or her back is increased. Additionally, less support is provided to the user when performing an abdominal curl. Thus, the user must work harder when the upper portion is reclined, than when it is brought forward as shown in FIG. 4.

As the upper portion 46 moves rearwardly and more horizontally, the end **64*a* of the lower portion 50 adjacent the pivot point 63 moves upwardly. The opposing end 64*b* moves downwardly, causing the lower portion 50 to pivot about the pivotable attachment 72**.

At the same time, the leg curl/extension apparatus 90 is moved into a first, extended position by either applying forward pressure on the leg support 106, or downward/forward pressure on the foot rest 140 to perform either a leg extension or a leg press. With each of the portions of the exercise apparatus in the first, extended position, a user 150 is in a fully extended position.

Referring now to FIG. 4, there is shown a side view of the fold/extension exercise apparatus 10 in a second, folded position. The handle 34 which is formed at the end of the pull-up/press bar 30 has been pulled downwardly into a position which would be adjacent the lap of the user. Such a movement causes the pull-up/press bar 30 to be disposed generally horizontally. The movement of the handles 34 from the position shown in FIG. 3 to the position shown in FIG. 4 uses similar muscle groupings as a conventional pull up.

As the handle 34 is drawn into the position shown, the pull-up/press bar 30 move downwardly, causing the brace 62 which is attached to the seating device 42 to move downwardly. Downward movement of the brace 62 causes a like movement in the pivot point 63, and thus the entire seating device 42.

As the brace 62 moves downwardly, the upper portion 46 of the seating device 42 is pivoted forward toward the lower portion 50. When the upper portion 46 of the seating device 42 is positioned as is shown in FIG. 4, the torso of the person (FIG. 3) using the exercise apparatus 10 is forced toward the person's legs, thereby performing a crunch. In the position shown in FIG. 4, however, the person need not expend considerable effort with the abdominal muscles to reach this position.

By having the upper portion 46 of the seating device 42 reclined into the position shown by dashed figure 66, the upper portion will not force the torso of the user toward the user's legs. Rather, the user must constrict his or her abdominal muscles to draw the torso and the legs together. Thus, by changing the position of the upper portion 46 of the seating device 42 relative to the brace 62 can significantly change the difficulty and effect of the workout received.

As the upper portion 46 of the seating device 42 moves downwardly, the seating frame 64 is pivoted so that the "upper" end **64*a* (which is disposed adjacent the pivot point 63) moves downwardly, and the lower end 64*b* of the seating frame moves upwardly, thereby giving the lower portion 50 of the seating device 42 a rearward, downward slope. As the lower portion 50 and the upper portion 46** pivot towards each other, the legs of the user are drawn toward the torso.

Assisting in moving the seating device 42 into the folded or curled position shown in FIG. 4 is the leg curl/extension apparatus 90. As a user of the exercise apparatus 10 flexes his or her hamstrings and calves so as to perform a leg curl, the ankles or calves pull inwardly on the rear leg supports 110. The rearward motion on the lower end 102 of the frame 94 of the leg curl/extension apparatus 90 causes the frame to move upwardly due to the attachment bar 136 which prevents the frame from being drawn into contact with the second generally vertical support column 26. The upward movement of the frame 94 contributes to upward movement of the lower end **64*b* of the seat frame 64**, thereby moving the user into an abdominal curl.

When both the handles 34 and the leg curl/extension apparatus 90 are pulled toward the seating device 42, the user is able to simultaneously perform a leg curl, an abdominal curl and a pull up. By extending the leg curl/extension apparatus 90 and the handle 34, the user is able to simultaneously perform a leg curl/extension, a bench press and work the back muscles. Those skilled in the art will recognize that, heretofore, these exercises required several machines and a considerable amount of time. Further, by rapidly moving back and forth between a folded or curl position and an extended position, the user can obtain an aerobic exercise as well.

In addition to using the handle 34 and pull-up/press bar 30, crunches and extensions can also be performed by the user holding onto the bracing handles 144 disposed adjacent the seating device 42. To perform a crunch, the user will grab the curved end **144*a* of the bracing handle 144 and pull inwardly (as if attempting to pull himself/herself from the seating device). As the user pulls inwardly on the curved end 144*a* of the bracing handle 144**, the user simulates a curl which exercises the biceps.

To move the exercise apparatus into the position shown in FIG. 2, the user presses outwardly on the curved end **144*a* of the bracing handle 144** while extending the back and legs. As the user presses outwardly, the user simulates a dip and works the triceps.

To change the difficulty of the curl or dip using the bracing handle 144, the position of the handle can be changed by loosening the knob 148 and then moving the bracing handle into the desired location. The knob 148 is then tightened to secure the bracing handle 144. Curls are made more difficult by moving the curved end **144*a* of the bracing handle 144 away from the user, while dips are made more difficult by moving the curved end toward the user. Thus, the user can adjust the bracing handle 144** to achieve the desired workout.

Figure 5:
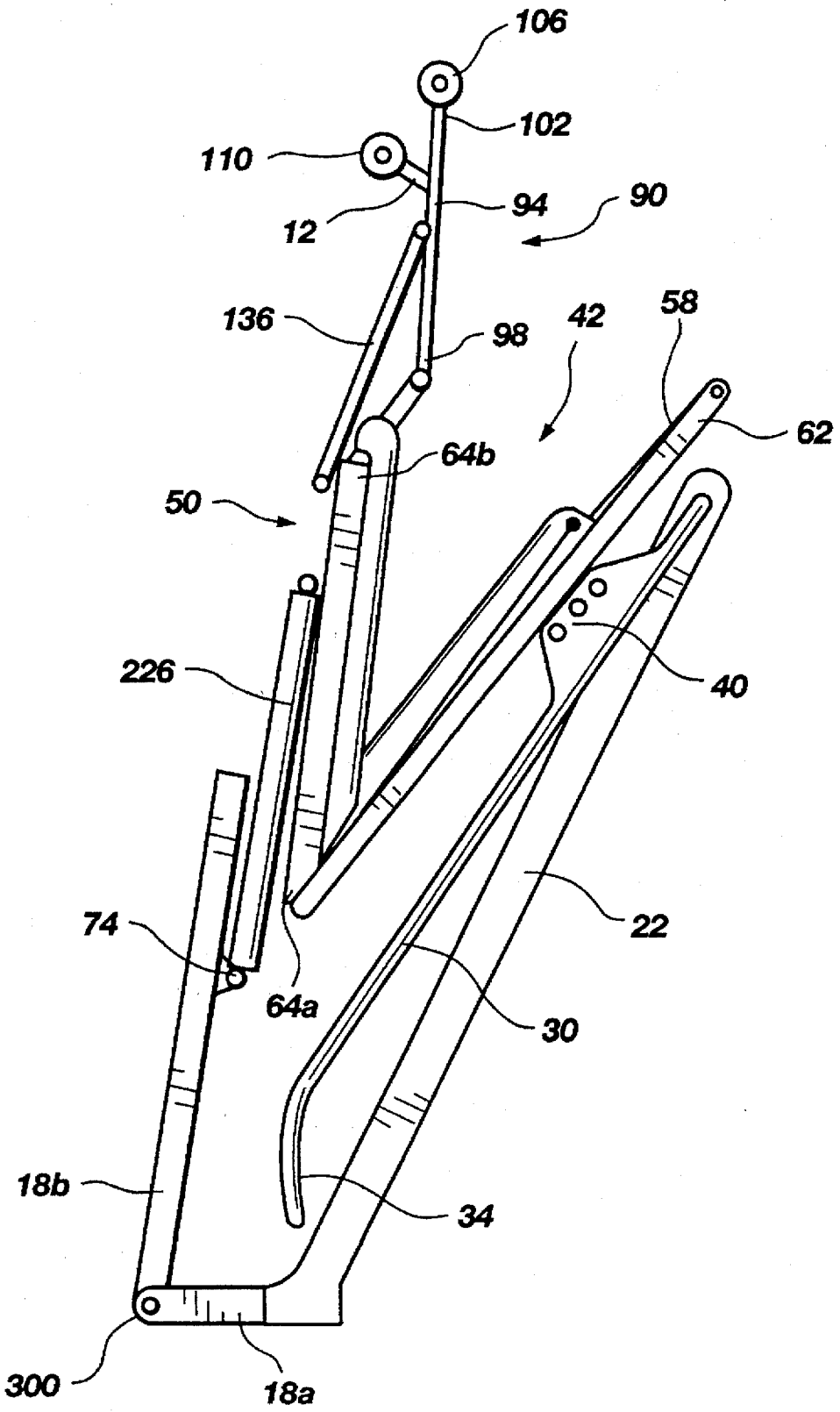
FIG. 5 shows a side view of the exercise apparatus of the present invention in a compacted arrangement such as could be used for storage.

Referring now to FIG. 5, there is shown a side view of an alternate embodiment of the exercise apparatus 210 of the present invention in a folded position as might be used to store the apparatus when not in use. The structural features of the embodiment shown in FIG. 5 is substantially the same as those in FIGS. 1 through 4 with a few minor modifications. Therefore, unless indicated to the contrary, it may be presumed that structures are the same and like numerals are used for designation purposes.

To achieve the compactible arrangement for the fold/extension exercise apparatus 210, a lock joint 300 is formed in the base portion 18 so that a first portion 18*a* is generally horizontal, and a second portion 18*b* can be moved into a generally vertical position.

The second generally vertical support column 226 is pivoted about pivotable attachment 74 with the base 18 so that the column remains disposed generally vertical even though the portion 18*b* of the base 18 to which it is attached has been rotated approximately 90 degrees. To keep the leg curl/extension apparatus 90 from extending outwardly beyond the second generally vertically support column 226, the attachment bar 136 which connects the leg curl/extension apparatus 90 to the second generally vertical support column is detached either from the frame 94, or from the second generally vertical support column 226. This allows the lower portion 50 of the seating device 42 to pivot freely about the support column 226 into a generally vertical position. When the lower portion 50 of the seating device 42 is generally vertical, the leg curl/extension apparatus 90, being attached only to the lower end 64*b* of the lower portion 50, is able to rotate into a position above the seating device 42 and slightly beyond vertical so that the weight of the leg curl/extension apparatus 90 holds it in place as shown in FIG. 5. Of course, the leg curl/extension apparatus 90 could be made to fold all the way over into a substantially horizontal position in which it would rest on the top of the upper portion 46 of the seating device 42.

The pivoting of the lower portion 50 of the seating device 42 is also made possible by detaching the brace 62 from the plate 40 on the pull-up/press bar 30. With the brace 62 detached, upper portion 46 is able to pivot further towards the lower portion 50 than when the brace 62 is attached to the seating device 42. Preferably, the arm 58 which connects the top of the upper portion 50 of the seating device 42 to the brace 62 is positioned to that the upper portion 58 is positioned almost parallel with the brace.

The disconnection of the brace 62 from the plate 40 also allows the pull-up/press bar 30 to rotate downwardly as shown in FIG. 5. In such a position, the pull-up/press bar 30 rests adjacent the first generally vertical support column 22, where it is out of the way.

Thus, by detaching the brace 62 and the attachment bar 136, and by releasing the lock joint 298 and pivoting the base portion 18*b*, the entire body fold/extension apparatus 210 can be compacted into a relatively small space—thereby facilitating storage when not in use. The apparatus 210 can then be either slid into a corner or placed in a closet for storage. Either way, considerable space is saved over the multiple machines which were required to perform the above described exercises before the development of the present invention.

The bracing handle 144 shown in the previous figures has been omitted from FIG. 5 because it would tend to obscure the view shown. However, those skilled in the art will appreciate that the knob 148 enables the bracing handle 144 to be rotated into a variety of positions to facilitate storage of the extension/fold apparatus 210 of the present invention.

Figure 6:
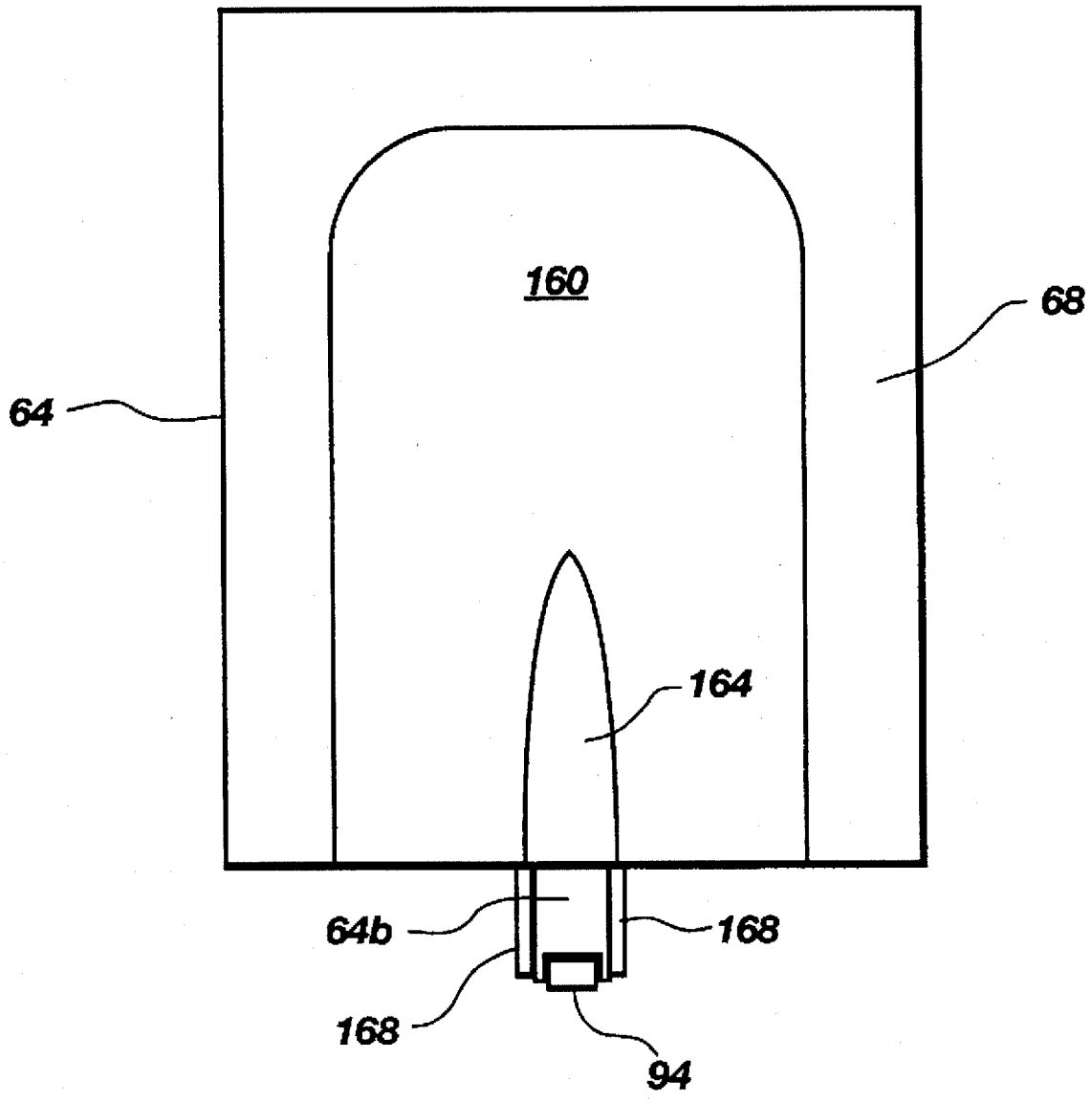
FIG. 6 shows a top view of a seat which may be used with the fold/extension exercise apparatus of the present invention.

Referring now to FIG. 6, there is shown a top view of seat padding 68 which may be used with the present invention. The seat padding 68 includes a depression 160 formed therein for receiving the buttocks and upper legs of a person using the machine. The depression 160 is formed so as to leave a raised portion 164 between the legs of the user sufficient that the user can grip the raised portion with his or her inner thigh. The raised portion 164 helps to prevent the user from sliding on the seat and provides an improved feeling of control.

Also shown in FIG. 6 are a pair of pads 168 which extend along the lower end 64*b* of the seat 64 to a position adjacent the attachment between the lower seat and the leg curl/extension apparatus 90 shown in FIGS. 1–5. The pads 168 provide additional surface to be gripped by the inner thigh of the user, and also help to prevent the user's knees, etc, being pinched between the lower end 64*b* of the seat 64 and the frame 94 of the leg extension apparatus 90 (FIGS. 1–4). The padding 68 and pads 168 enable the user to move between the first, extended position and the second, folded position rather vigorously without sliding off of the exercise apparatus.

Figure 7:
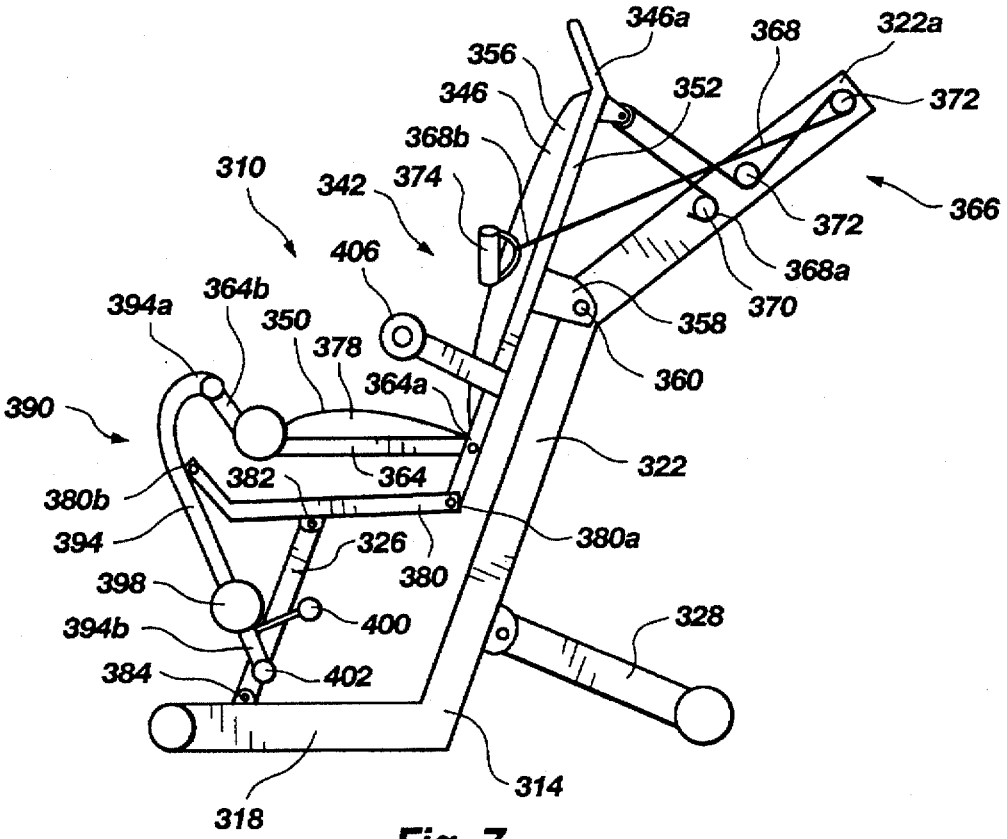
FIG. 7 shows an alternate embodiment of the present invention wherein the pull/press cables are used to exercise the arms in place of the pull-up/press bars and to move the apparatus between folded and extended positions, the apparatus being in the folded position.
Figure 7A:
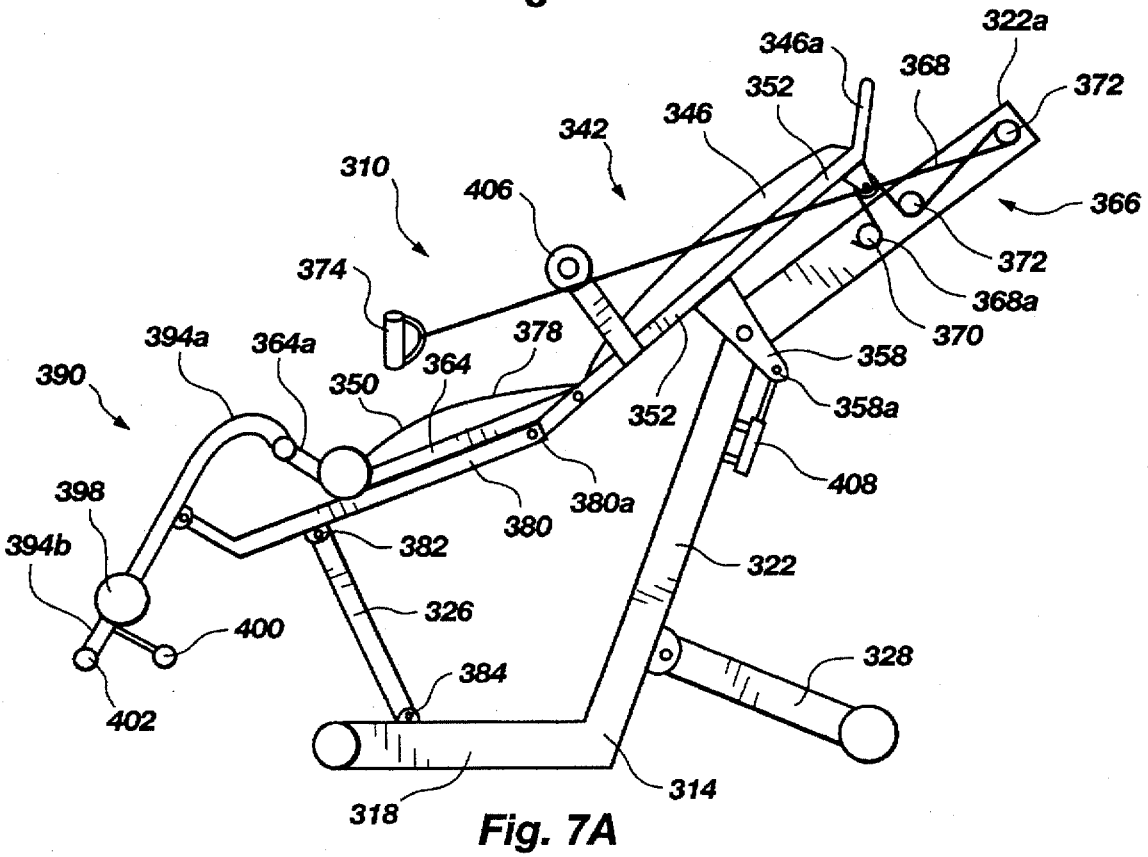
FIG. 7A shows the embodiment of FIG. 7 in the extended position.

Referring now to FIG. 7, there is shown a side view of another embodiment of the present invention. The fold/extension exercise apparatus, generally indicated at 310, is disposed in a somewhat folded state. As with the other embodiments discussed, the fold/extension exercise apparatus 310 is moveable between a first, extended position, as is shown in FIG. 7A, and a second, somewhat folded position, as is shown in FIG. 7, so as to enable the user to work all of the major muscle groups using the exercise apparatus.

The exercise apparatus 310 includes a support frame, generally indicated at 314, with a generally horizontally disposed base portion 318 which rests on a floor or other flat surface (not shown). The support frame 314 further includes at least one first generally vertical support column 322, extending upwardly from the base portion 318 near a rearward side thereof, and at least one second generally vertical support column 326, also extending upwardly from the base portion adjacent a forward side thereof. A stabilizer bar 328 may also be provided to provide stability during vigorous workouts so as to prevent the support frame 314 from accidentally tipping rearwardly.

As with the other embodiments, a pivotable seating device 342 is provided having an upper portion 346, and a lower portion 350. The upper portion 346 of the pivotable seating device 342 includes a back rest frame 352 which typically has padding 356 attached thereto to cushion the back of a user seated in the pivotable seating device. One or more attachment arms 358 extends rearwardly to an adjustable attachment 360 with the first generally vertical support column 322. The attachment 360 enables the upper portion 346 of the seating device 342 to pivot with respect to the first generally vertical support column 322 as the upper portion moves between the first, extended position and the second, folded position.

At an upper end 322*a* of the first, generally vertical support column 322 is a pulley system, generally indicated at 356. The pulley system 366 includes a cable 368 which is attached at a first end 368*a* to the first generally vertical support column 322. The cable 368 winds around wheels 372 disposed on the first generally vertical support column 322, and around a wheel 374 disposed at the upper end 346*a* of the pivotable seating device 342. When a handle 374 disposed at the second end 368*b* of the cable 368 is pulled into a first, extended position, movement of the cable causes the wheel 374 to be drawn toward the first generally vertical support column 322 and causes the upper portion 346 of the seating device 342 to pivot about the attachment 360. When the handle 374 is moved into the second, folded position, the seating device 342 is pivoted about the attachment 360 into a folded position.

As the upper portion 346 of the seating device 342 pivots rearwardly, the seating device 342 moves from the folded position shown in FIG. 7 to the extended position shown in FIG. 7A. During this movement, the torso of a user (not shown) moves from a position in which it is generally perpendicular to his or her upper legs to a position in which the torso and legs are somewhat parallel. The lower portion 350 of the seating device 342 is also modified somewhat from the embodiments discussed above. The lower portion 350 of the pivotable seating device 342 includes a seat frame 364 which typically has a padding 378 attached thereto. At a first end 364*a*, the seat frame 364 is attached to the back rest frame 352. At an opposing second end 364*b*, the seat frame 364 is attached to a leg curl/extension apparatus, generally indicated at 390, which will be discussed in detail below.

Unlike the previously discussed embodiments, the seat frame 364 is not rotatably attached to the second generally vertical support column 326. Rather, the back rest frame 346 extends to a position below the attachment to the first end 364*a* of the seat frame 364. Attached to the back rest frame 346 below the seat frame 364 is a base frame 380 which is functionally part of the seating device 342, even though it is not directly sat on by the user. The base frame 380 is pivotably attached to the back rest frame 346 at a first end 380*a*, and is attached to the leg curl/extension apparatus 390 at an opposing second end 380*b*.

Attached to the base frame 380 between the first and second ends, 380*a* and 380*b*, is the second generally vertical support column 326. The attachment 382 between the base frame 380 and the second generally vertical support column 326 will typically be pivotable so that the base frame 380 can pivot with respect to the column. An attachment 384 between the second generally vertical support column 326 and the base portion 318 of the base frame 314 is also pivotable to allow movement of the support column as the seating device 342 moves between folded and extended positions, as are shown in FIGS. 7 and 7A respectively.

Referring now to the leg curl/extension apparatus 390, the apparatus includes a curved frame 394 which is attached at a top end 394*a* to the second end of the seat frame 364*b*. At an opposing lower end 394 of the leg curl/extension frame 394, are a pair of leg supports 398 and 400, respectively. A first, forward leg support 398 is positioned so as to be forward of a user's leg, and the second, rearward support 400 is positioned to be disposed behind the user's leg adjacent the calf or heel. The two leg supports hold the user's foot within the leg curl/extension apparatus 390. The user's legs may be removed by sliding the legs and feet to the sides beyond the leg supports 398 and 400. A foot rest 402 may also be provided distally of the leg supports 398 and 400 both for comfort and to allow leg presses.

As with the prior embodiments, the leg curl/extension apparatus 390 allows the user to perform leg curls, leg presses (using the foot rest 402) and leg extensions. As the user performs a leg extension or a leg press, the seating device 342 will be urged into the extended position shown in FIG. 7A. As a leg curl is performed, the seating device 342 is urged into the folded position shown in FIG. 7. Of course, the user can facilitate movement of the seating device 342 into the folded position by also performing an abdominal crunch while releasing pressure on the handles 374. Likewise, the user extending his or her back and pulling forwardly/downwardly on the handles 374 will move the seating device 342 into the extended position.

Also shown in FIGS. 7 and 7A is a safety belt 406. The safety belt 406 is anchored to the seating device 342 and helps to prevent a user from sliding out of the seating device during rapid folding and extension of the exercise apparatus 310.

The embodiment shown in FIG. 7A is slightly different than that shown in FIG. 7 in that the attachment arm 358 extends beyond the first generally vertical support frame 322. A resistance device, such as a shock absorber or linear decelerator 408 is attached to an end 358*a* of the arm 358 to provide resistance. Because of the interactive nature of the exercise apparatus 310, the resistance device provides resistance for the leg curl/extension apparatus 390, the seating device 342 and the cable 368 of the pulley system 366. The resistance mechanism 408, of course, could be any mechanism for providing resistance such as hydraulics, pneumatics, electromagnetic devices or spring dampened devices. The resistance device may also be adjustable to provide differing amounts of resistance depending on the desires of the user.

Figure 8:
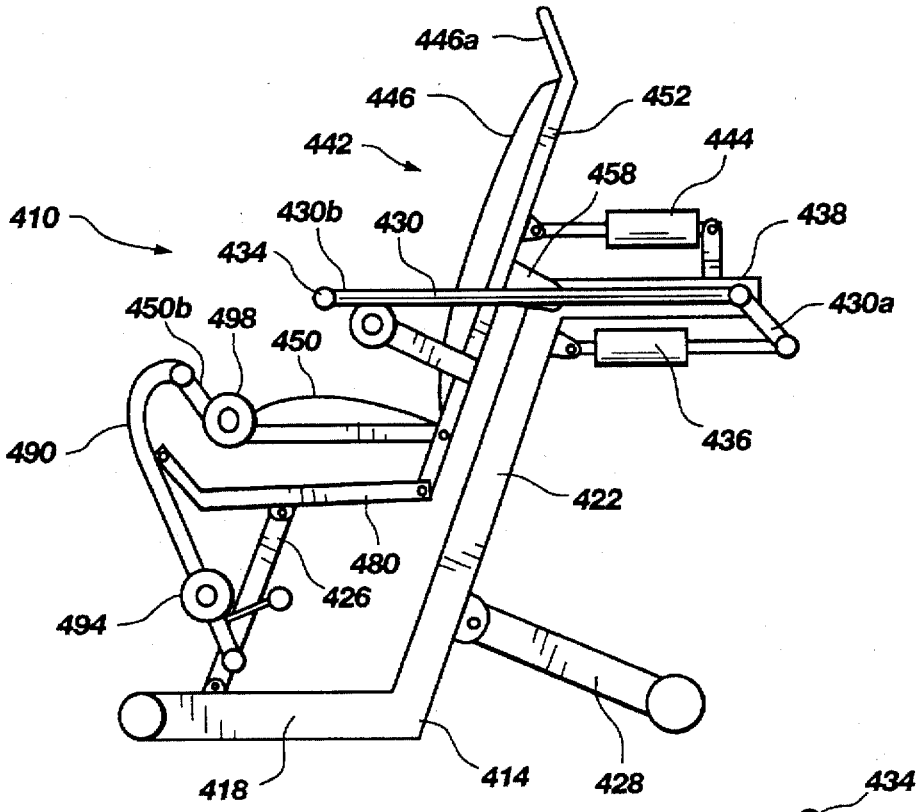
FIG. 8 shows another embodiment of the present invention, wherein the pull-up/press bars function independently of the pivotable seat member, the apparatus being in the folded position.
Figure 8A:
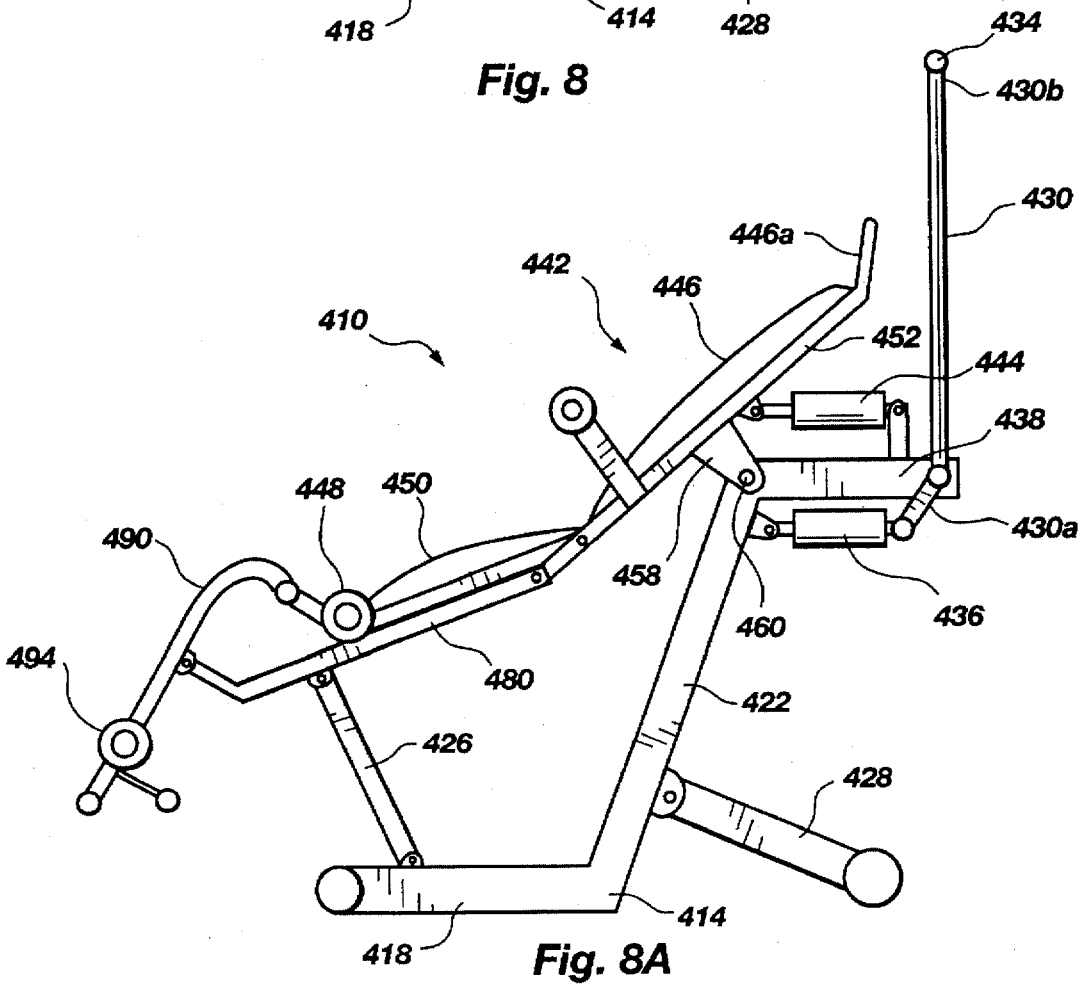
FIG. 8A shows the embodiment of FIG. 8 in the extended position.

Referring now to FIGS. 8 and 8A, there are shown side views of yet another embodiment of the present invention in folded and extended positions, respectively. The fold/extension exercise apparatus 410 includes a support frame 414 with a base portion 418, a first generally vertical support column 422 and a second generally vertical support column 426. A stabilizer bar 428 may also be included to prevent the support frame 414 from rocking rearwardly when the apparatus 410 is being vigorously used.

The support frame 414 supports a pivotable seating device, generally indicated at 442, which is configured in a similar manner as the seating device 342 discussed with respect to FIGS. 7 and 7A. The seating device 442 includes an upper portion 446 and a lower portion 450. The upper portion 446 includes a back rest frame 452 which is constructed in a similar manner as the back rest frame 352 discussed relative to FIGS. 7 and 7A. Along the back rest frame 452, an attachment arm 458 extends rearwardly to an attachment 460 with the first generally vertical support column 422. The attachment 460 allows the upper portion 446 of the seating device 442 to pivot with respect to the first generally vertical support column 422, thereby allowing the seating device 442 to pivot between a folded position, such as is shown in FIG. 8, and an extended position, such as is shown in FIG. 8A.

Unlike the upper portion 346 of the embodiment discussed in FIGS. 7 and 7A, no pulley mechanism 366 is provided. Rather a pull-up/press bar 430 is disposed adjacent a rearward end of the apparatus 410. The pull-up/press bar 430 has first and second ends 430*a* and 430*b*, respectively, the first end being pivotably being attached to a resistance device 436 and the second end being attached to a handle 434. Adjacent the first end 430*a*, the pull-up/press bar 430 is pivotably attached to an arm 438 extending from the first generally vertical support column 422 so that the majority of the pull-up/press bar is disposed on an opposite side of the arm from the resistance device 436. As the handle 434 is pulled down toward the seating device 442 or pressed away therefrom, the resistance device 436 resists movement of the bar 430. Of course, the resistance device 436 could be placed on the same side of the arm 438 as the handle 434 if desired and those skilled in the art will appreciate the minor design changes which would be necessary to implement the same.

Because the pull-up/press bar 430 is able to move independently from the seating device 442, a second resistance device 444 is provided. The second resistance device 444 is attached to the arm 438 extending from the first generally vertical support column 422, and to the upper portion 446 of the seating device 442. The second resistance device 444 thus provides resistance to the seating device 442 as it is moved between the first, extended position shown in FIG. 8A, and the second, folded position shown in FIG. 8.

To operate the fold/extension exercise apparatus 410 shown in FIGS. 8 and 8A, the user sits in the seating device 442 and places his or her legs in the leg curl/extension apparatus 490 between the leg supports and adjacent the foot rest, all generally indicated at 494. A pad 498 disposed at the second end **450*b* of the lower portion 450** is positioned to provide support for and to protect the user's legs while using the leg curl/extension apparatus.

In addition to being attached to the lower portion 450 of the seating device 442, the leg curl/extension apparatus 490 is also connected to the base frame 480 in a similar manner as discussed with respect to FIGS. 7 and 7A. As the lower portion 450 of the seating device 442 and the base frame 480 move relative to one another, the leg curl/extension apparatus 490 is also forced to move. Likewise, movement of the leg curl/extension apparatus 490 causes the lower portion 450 of the seating device 442 to move relative the base frame 480.

As was mentioned previously, the pull-up/press bar 430 of the present embodiment is able to move independently of the seating device 442 and the leg curl/extension apparatus 490. However, if additional assistance is needed in moving the seating device 442 and the leg curl/extension apparatus 490 between the first, extended position (FIG. 8A) and the second, folded position (FIG. 8), the user can pull or push on a handle formed by the upper end **46*a* of the upper portion 446 of the seating device. Pulling on the handle of the upper end 446*a*** of the upper portion causes the user to engage in isometric-like exercise of the arms, as does pushing against the handle during extension.

In most other respects, the seating device 442 operates in a similar manner as the seating device 342 of FIGS. 7 and 7A. As the seating device 442 moves between the first and second positions, the second generally vertical support column 426 pivots forwardly and rearwardly, while the first generally vertical support column 422 remains substantially stable.

Figure 9:
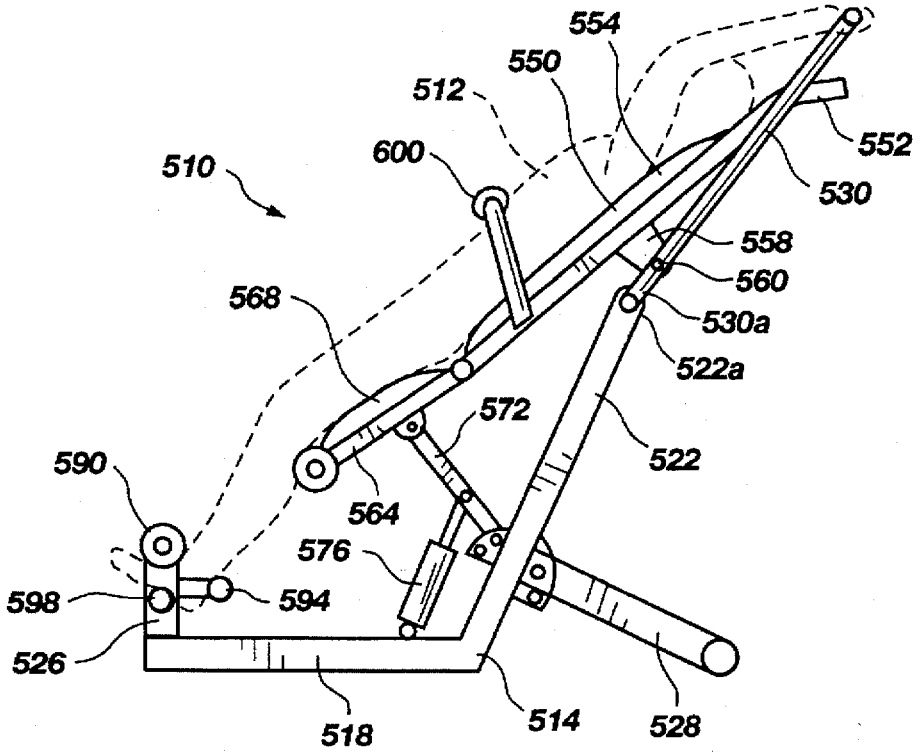
FIG. 9 shows a side view of a person using yet another embodiment of the present invention wherein the leg curl/extension apparatus is formed integrally with the frame, and wherein the pivotable seat member moves toward and away from the leg curl/extension apparatus as it moves between folded and extended positions.
Figure 9A:
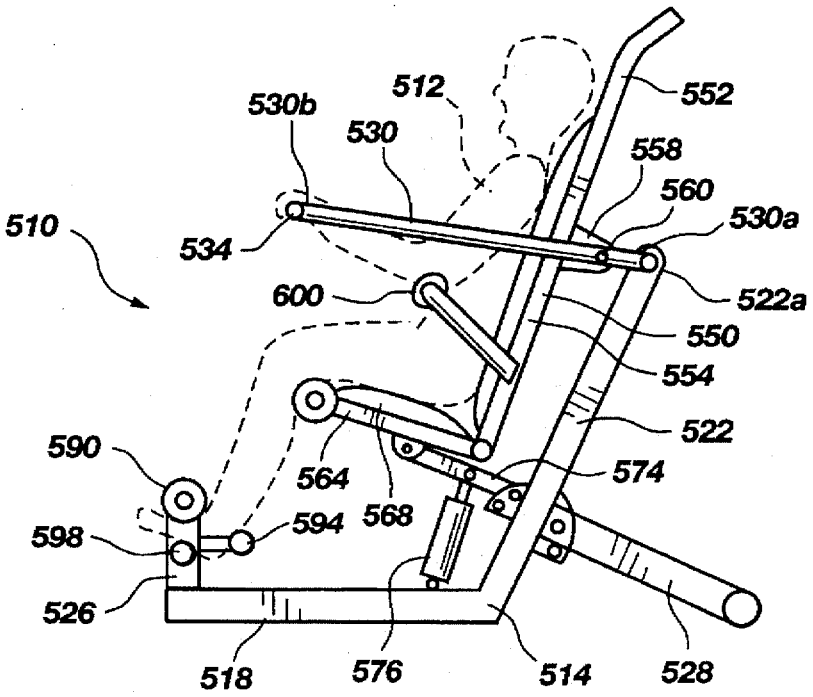
FIG. 9A shows a side view of the person and embodiment of FIG. 9, the fold/extension apparatus being in a folded position.

Referring now to FIGS. 9 and 9A, there are shown side views of an extended position and a folded position, respectively, of a fold/extension exercise apparatus, generally indicated at 510, made in accordance with the principles of the present invention. A person 512 is also shown to demonstrate the use of the device.

The device includes a support frame 514 having a base portion 518 disposed generally horizontally, and a first generally vertical support column 522 extending upwardly therefrom. A second generally vertical support column 526 may also be provided, the purpose for which will be discussed momentarily. A stabilizing bar 528 may also be provided to prevent the support frame 514 from rocking backward when the person 512 is in an extended position, as is shown in FIG. 9.

A pull-up/press bar 530 is disposed so that a first end **530*a* is attached to a handle 534 which may be gripped by the user and pulled down or pushed up. An opposing second end 530*b* of the pull-up/press bar 530 is pivotably attached to an upper end 522*a* of the first generally vertical support column 522**.

A seating device 542 having an upper portion 546 and a lower portion 550 which are pivotably attached to one another is also provided. The seating device 542 has an attachment arm 558 extending rearwardly from the upper portion 546. The attachment arm 558 has a pivotable attachment 560 with the pull-up/press bar 530 so that when the pull-up/press bar is lifted upwardly, the upper portion 546 of the seating device 542 is drawn upwardly and rearwardly, thereby pivoting the seating device into the extended position shown in FIG. 9. Pulling the handle 534 of the pull-up/press bar 530 downwardly moves the seating device 542 downwardly and into a move vertical, folded positions, as is shown in FIG. 9A.

Like the previously discussed embodiments, the upper portion 550 includes a back rest frame 552 and padding 554, and the lower portion 550 includes a seat frame 564 with padding 568. Unlike the embodiments discussed above, the lower portion 550 of the seating device 542 is not attached to the second generally vertical support column 526, nor is there a brace frame (such as is shown in FIGS. 7 through 8A) disposed below the lower portion. Rather, a pivoting support column 574 is attached to the seating device 542 at one end and to the first generally vertical support column 522 at an opposing end.

When the seating device is disposed in a folded position, as is shown in FIG. 8A, the pivotable support column 574 is disposed generally horizontally. When the seating device 542 is moved into the extended position shown in FIG. 8, the pivotable support column 572 pivots into a position halfway between vertical and horizontal. A resistance device 576 may be provided to increase difficulty in moving between extended and folded positions.

In another significant difference versus the prior embodiments, no leg curl/extension apparatus is attached to the lower portion 550 of the seating device 542. Instead, a first leg support 590 and a second leg support 594 are provided at the top of the second generally vertical support column 526. A foot rest 598 may also be provided.

Rather than being attached to a moveable leg curl/extension apparatus, the leg supports 590 and 594 and the foot rest 598, when provided, form a stationary foot anchoring mechanism. However, because the seating device 542 will move away from the leg supports 590 and 504 when moving into the extended position and will move towards the leg supports when moving into the folded position, the leg supports and foot rest 598 function in a similar manner as the leg curl/extension devices of the prior embodiments. Performing a leg curl will draw the seating device 542 down into a folded position (FIG. 8A) wherein the leg supports 590 and 594 are positioned about the same distance from the seating device 542 as some of the leg supports of the previously discussed embodiments. When performing a leg extension or leg press, the distance between the leg supports 590 and 594 and the seating device 542 is increased, thereby moving the seating device into an extended position (FIG. 8). Thus, the stationary leg supports 590 and 594, and foot rest 598, when provided, form a leg curl/extension apparatus via the frame's connection to the leg supports and the seating device 542.

Also shown in FIGS. 9 and 9A is a belt 600 which is attached to the upper portion 546 of the seating device 542. As with previous embodiments, the belt 600 helps to hold the torso of the user adjacent the upper portion 546 of the seating device 542 during vigorous exercise.

Figure 10:
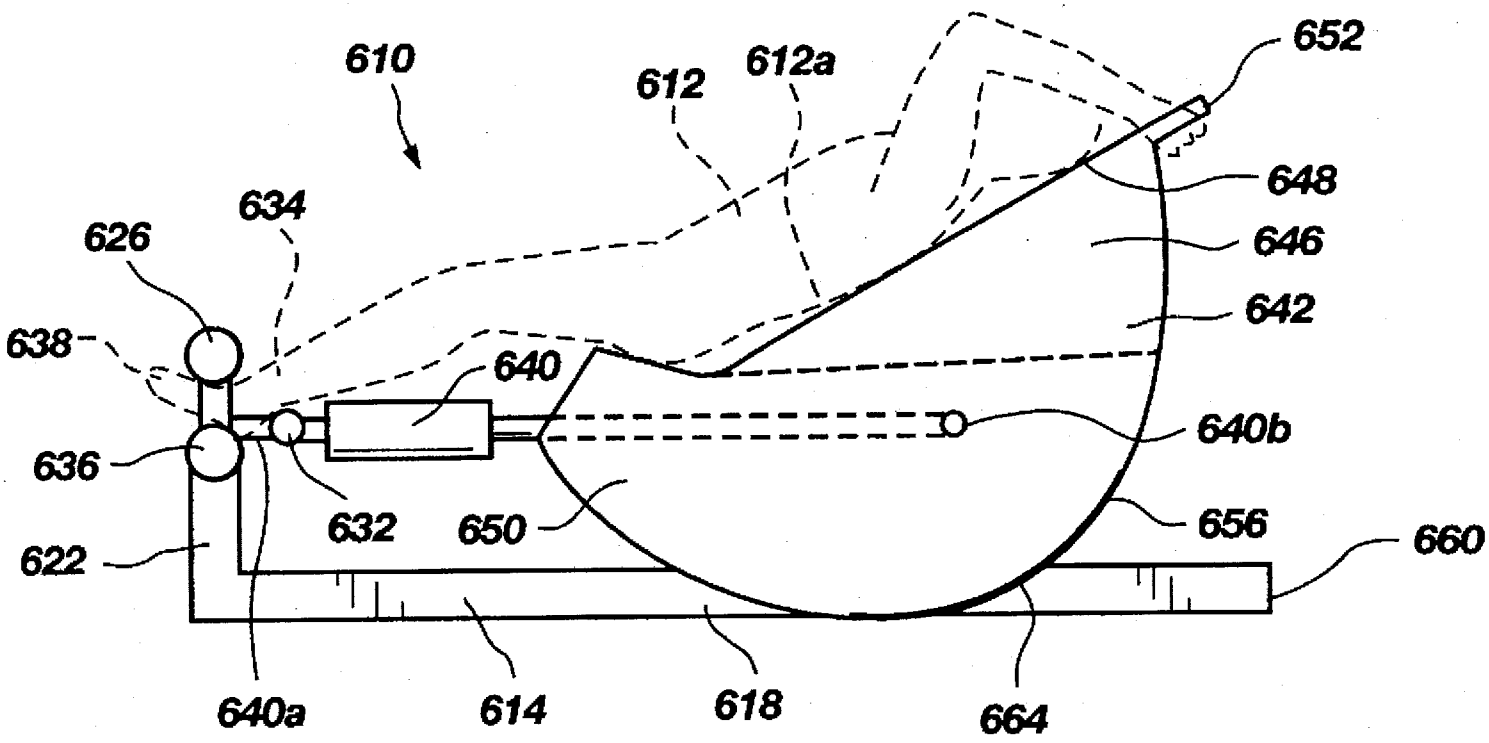
FIG. 10 shows still another embodiment of the present invention with a person disposed thereon, the apparatus being in an extended position.
Figure 10A:
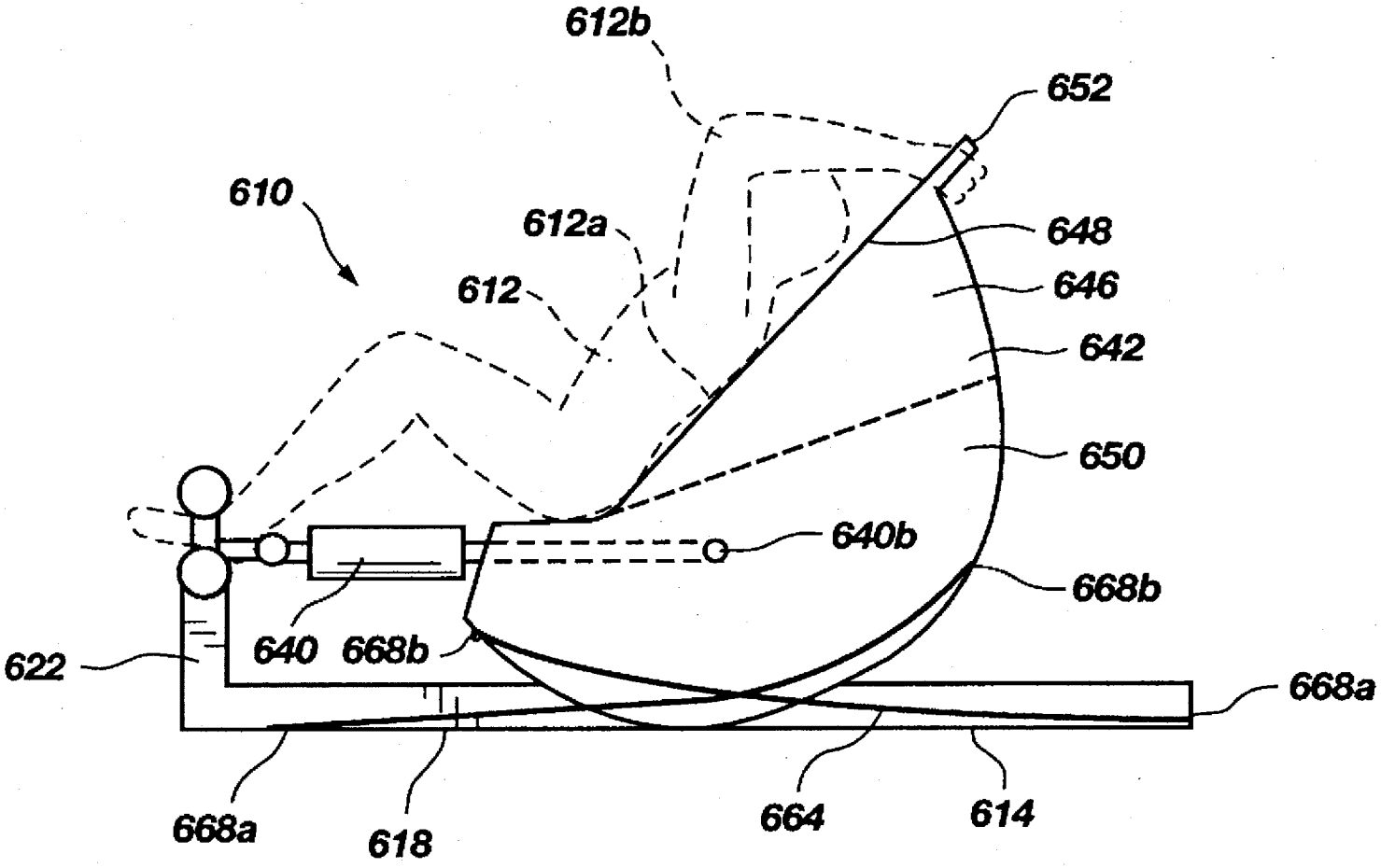
FIG. 10A shows a side view of the embodiment of FIG. 10 in an extended position.

Referring now to FIGS. 10 and 10A, there are shown side views of another embodiment of a fold/extension exercise apparatus 610 made in accordance with the teachings of the present invention. A person 612 is disposed thereon to shown the fold and extension of the human body during use of the apparatus and movement of the same between the first, extended position and the second, folded position.

Referring specifically to FIG. 10, there is shown the exercise apparatus 610 in a first, extended position. The apparatus 610 includes a frame 614 with a base portion 618 and a support column 622. Leg supports 626 and 632 are provided for holding the ankles 634 of the user 612 during the exercise. A foot rest which can be used as a press bar (hereinafter "foot rest/press bar 636") may also be provided to support the foot 638 and broaden the range of exercises available with the apparatus.

Disposed adjacent the leg supports 626 and 632 and extending from the support column 622 is a resistance mechanism 640. Those skilled in the art will appreciate that numerous different types of resistance mechanisms may be provided.

While a first end 640*a* of the resistance mechanism 640 is attached to the support column 622, an opposing second end 640*b* is attached to a seating device 642. The seating device 642 has an upper portion 646 and a lower portion 650 which are segmented for the purpose of discussion by a dashed line.

The upper portion 646 has a generally planar surface 648 on which the back 612*a* of the user may rest. A pair of bars or handles 652 extend upwardly from the upper portion 646 and may be used to press outwardly or pull inwardly as the user moves between the first, extended position, shown in FIG. 10, and the second, folded position, shown in FIG. 10A.

The lower portion 650 of the seating device 642 has a broadly rounded bottom surface 656 which allows the seating device to roll forwardly and rearwardly on the frame 614 or on a floor surface 660 adjacent the frame. The bottom surface 656 may be roughened or at least partially coated with a high friction material 664, such as neoprene or rubber, to prevent slippage. In the alternative, as is shown in FIG. 10A, ropes 668 may be attached to the frame 614 and to the seating device 642 to allow the lower portion 650 of the seating device to roll, while limiting the ability to slide as a user performs leg curls and extensions. Typically, each rope 668 will be attached at a first end 668*a* to the frame 614, and at an opposing second end 668*b* to the lower portion 650 of the seating device 642 on a side opposite the point of attachment to the frame.

When the user desires to move the seating device into the first, extended position, he or she must push backwardly with his or her arms, extend his or her torso, and perform a leg extension or leg press. This will cause the seating device 642 to roll rearwardly, extending the user's torso and legs.

To move the seating device into the second, folded position, as is shown in FIG. 10A, the user must simultaneously perform an abdominal crunch and a leg curl to overcome the resistance of the resistance mechanism 640 and to roll the seating device 642 forward. Depending on the strength of the resistance mechanism 640, the arms 612*b* of the user 612 may also be necessary to pull the upper portion 646 of the seating device 642 into a more vertical position.

Thus, the variable distance between the leg supports 626 and 632, and the seating device 642, form a leg curl/extension means, while the changing position of the seating device 642 allows for abdominal crunching and extension.

The arms in this embodiment are exercised, but in an isometric-like manner. As the user moves into the first, extended position, shown in FIG. 10, the user will typically apply a rearward pressure with his or her arms, thereby helping the seating device 642 to roll rearwardly. To move the seating device 642 into the second, folded position, the user will usually assists his or her legs and abdomen by pulling inwardly on the handles 652 much in the same manner as is often done with sit-ups. In such a manner, the embodiment shown in FIGS. 10 and 10A provides a workout for the arms, the legs and the abdominal muscles.

Thus, there is disclosed an improved fold/extension exercise apparatus which enables a user to work the major muscle groups simultaneously. The fold/extension exercise apparatus decreases the amount of workout time necessary, and decreases the amount of space consumed by the exercise equipment.

Those skilled in the art will recognize numerous modifications which can be made to the fold/extension apparatus without departing from the scope and spirit of the present invention. The appended claims are intended to cover such modifications.

What is claimed is:

1. A fold/extension exercise apparatus comprising:

a support frame;

a seating means for seating a person connected to the support frame, the seating means having an upper portion and a lower portion movable between a first, extended position wherein upper portion is disposed in a non-vertical position and a second, folded position wherein the upper portion is disposed generally vertically;

pull-up/press means disposed adjacent the seating means, the pull-up/press means being movable relative to the support frame between a first, extended position and a second, folded position; and leg curl/extension means disposed adjacent to the seating means on a side opposite the pull-up/press means, the leg curl/extension means being movable away from the seating means into a first extended position and towards the seating means into a second, folded position.

2. The fold/extension exercise apparatus of claim 1, wherein the support frame includes a generally horizontally disposed base portion, and at least one generally vertically disposed support column.

3. The fold/extension exercise apparatus of claim 2, wherein the leg curl/extension means is attached to the at least one generally vertical support column.

4. The fold/extension exercise apparatus of claim 2, wherein the at least one generally vertically disposed support column comprises a first generally vertical support column and a second generally vertical support column, the first generally vertical support column being fixed relative to the base portion.

5. The fold/extension exercise apparatus of claim 4, wherein the pull-up/press means is pivotably attached to the first generally vertical column.

6. The fold/extension exercise apparatus of claim 4, wherein the pull-up/press means comprises a cable having an end with a handle attached thereto, and an opposing end attached to the first generally vertical support column.

7. The fold/extension exercise apparatus of claim 4, wherein the second generally vertical support column is fixedly attached to the base portion.

8. The fold/extension exercise apparatus of claim 4, wherein the second generally vertical support column is pivotably attached to the base portion.

9. The fold/extension exercise apparatus of claim 8, wherein the second generally vertical support column is privotably attached to the seating means.

10. The fold/extension exercise apparatus of claim 1, wherein the upper portion and lower portion are pivotably connected to one another, such that the upper and lower portions pivot away from one another into the first, extended position, and toward one another into the second, folded position.

11. The fold/extension exercise apparatus of claim 10, wherein the support frame has at least one generally vertical support column, and wherein the seating means further comprises a base portion which is pivotably connected to the at least one generally vertical support column.

12. The fold/extension exercise apparatus of claim 11, wherein the leg curl/extension means is pivotably attached to the lower protion of the seating means and is pivotably attached to the at least one generally vertical support column.

13. The fold/extension exercise apparatus of claim 10, wherein the leg curl/extension means is pivotably attached to the lower portion of the seating means.

14. The fold/extension exercise apparatus of claim 10, wherein the support frame comprises at least one generally vertical support column, and wherein seating means further comprises a base frame disposed below the lower portion, the upper portion being pivotably attached to the base frame and the base frame being attached to the at least one generally vertical support column.

15. The fold/extension exercise apparatus of claim 14, wherein the at least one generally Vertical support column includes first and second generally vertical support columns, the upper portion being attached to the first generally vertical support column, and the base frame being pivotably connected to the second generally vertical support column.

16. The fold/extension exercise apparatus of claim 10, wherein the support frame comprises a first generally vertical support column, the upper portion and the lower portion each being pivotably attached to the first generally vertical support column.

17. The fold/extension exercise apparatus of claim 16, wherein the leg curl/extension means comprises leg support means fixedly attached to the support frame, and wherein the seating means moves toward the leg support means when the seating means is moved into the second, folded position.

18. The fold/extension exercise apparatus of claim 1, wherein the seating means comprises a upper portion having a seat formed therein for receiving the back and buttocks of a user, and a broadly rounded lower portion disposed so as to roll forward and backward between a first, extended position and a second, folded position.

19. The fold/extension exercise apparatus of claim 18, wherein the seating means is attached to the support frame by a resistence means.

20. The fold/extension exercise apparatus of claim 18, wherein the lower portion has a high friction material disposed thereon to prevent sliding of the lower portion as it rolls forward and backward.

21. The fold/extension exercise apparatus of claim 18, wherein the seating means is attached to the support frame by at least one rope, the rope having a first end attached to the support frame and a second end attached to the seating means on a side of the seating means opposite the attachment of the first end to the support frame.

22. The fold/extension exercise apparatus of claim 21, wherein the leg curl/extension means comprises at least one leg support fixedly attached to the support frame.

23. The fold/extension exercise apparatus of claim 1, wherein the support frame has at least one generally vertical support column, and wherein the pull-up/press means comprises at least one elongate bar pivotably attached to the at least one generally vertical support column.

24. The fold/extension exercise apparatus of claim 23, wherein the seating means comprises an upper portion and a lower portion pivotably attached to one another, and wherein the elongate bar of the pull-up/press means is also pivotably attached to the seating means.

25. The fold/extension exercise apparatus of claim 1, wherein the pull-up/press means comprises a cable connected to the seating means such that pulling on the cable moves the seating means between the first, extended position and the second, folded position.

26. An extension/fold exercise apparatus for use by a person, the apparatus comprising:

a seating means for seating a person, the seating means having a first, extended position and a second, folded postion, the seating means being rollable between the first and second positions;

a support frame disposed adjacent to the seating means and having a leg support means disposed thereon for holding legs of the person while seated in the seating means; and a resistance means for attaching the seating means to the support frame and for resisting movement of the seating means relative to the support frame.

27. The exercise apparatus of claim 26, wherein the seating means is rollable on a hortizontal surface, and wherein the seating means has an upper portion with a seat formed therein, and a braodly rounded lower portion for rolling on the horizontal surface.

28. The exercise apparatus of claim 27, wherein the horizontal surface is formed by the support frame.

29. The exercise apparatus of claim 27, wherein the horizontal surface is a floor.

30. The exercise apparatus of claim 26, wherein the seating means is attached to the support frame by at least one rope.

31. The exercise apparatus of claim 27, wherein the broadly rounded lower surface is coated with a high friction material.

32. An exercise apparatus comprising:

a seating means for seating a person, the seating means having an upper portion and a lower portion pivotably attached to one another, the seating means being pivotable between a first, extended position wherein upper and lower portions are pivoted away from each other and a second, folded position wherein the upper and lower portions are drawn towards one another;

pull-up/press means pivotably attached to the seating means and having a free end movable relative thereto between a first position away from the seating means and a second position adjacent the seating means, such that when the seating means is disposed in the first, extended position, the free end of the pull-up/press means is disposed in the first extended, position extended away from the seating means and such that when the seating means is disposed in the second, folded position, the free end is disposed adjacent the seating means; and leg curl/extension means disposed adjacent to the seating means, wherein the seating means moves relative to the leg curl/extension means as the seating means moves between the first, extended position and the second, folded position.

33. The exercise apparatus of claim 32, wherein the apparatus further comprises a support frame having at least one generally vertical support memeber, and wherein the seating means is pivotably attached to the at least one generally vertical support member.

34. The exercise apparatus of claim 33, wherein the apparatus further comprises resistance means for resisting movement of the seating means between the first and second positions.

35. A fold/extension exercise apparatus comprising:

a seating means for seating a person, the seating means having an upper portion and a lower portion pivotably attached to one another, the seating means being pivotable between a first, extended position wherein upper and lower poritons are pivoted away from each other and a second, folded position wherein the upper and lower portions are drawn towards one another;

pull-up/press means pivotably attached to the seating means and having a free end movable relative thereto between a first position away from the seating means and a second position adjacent the seating means, such that when the seating means is disposed in the first, extended position, the free end of the pull-up/press means is disposed in the first position extended away from the seating means and such that when the seating means is disposed in the second, folded postion, the free end is disposed adjacent the seating means; and leg curl/extension means connected to the seating means, the leg curl/extenstion means being movable between a first extended positon and a second, folded position.

36. The fold/extension exercise apparatus of claim 35, wherein the leg curl/extension means is pivotably attached to the seating means.

37. The fold/extension exercise apparatus of claim 36, wherein the leg cur/extension means is disposed such that when the seating means is disposed in the first, extended position, the leg curl/extension means is also disposed in its first, extended position.

38. The fold/extension exercise apparatus of claim 36, wherein the leg curl/extension means is attached to the seating means such that movement of the seating means into the second, folded position causes the leg curl/extension means to move into its second, folded position and vice-versa.

39. The fold/extension exercise apparatus of claim 35, wherein the apparatus further comprises a support frame pivotably connected the the seating means so as to support the seating means as the seating means moves between the first, extended position and the second, folded position..

40. The fold/extension exercise apparatus of claim 39, wherein the support frame is attached to the leg curl/extension means so as to limit movement of the leg curl/extension means relative to the support frame and relative to the seating means.

41. The fold/extension exercise apparatus of claim 39, wherein the pull-up/press means is pivotably attached to the support frame at a point independent of the seating means.

42. The fold/extension exercise apparatus of claim 41, wherein the pull-up/press means comprises at least one elongate bar having a first end adjacent the point of independent attachment to the support frame and a second end disposed opposite the first end, the second end having a handle attached thereto.

43. The fold/extension exercise apparatus of claim 42, wherein the at least one elongate pull-up/press bar comprises a middle portion disposed between the first and second ends, the seating means being attached to the at least one elongate pull-up/press bar along said middle portion.

44. The fold/extension exercise apparatus of claim 42, wherein the pull-up/press means comprises at least two elongate pull-up/press bars adjustably attached to one another so as to enable change of length for the pull-up/press means.

45. The fold/extension exercise apparatus of claim 39, wherein the apparatus further comprises resistance means for resisting pivoting of the seating means relative to the support frame.

46. The fold/extension exercise apparatus of claim 45, wherein the resistance means comprises a shock absorber.

47. The fold/extension exercise apparatus of claim 45, wherein the resistance means comprises a linear decelerator.

48. The fold/extension exercise apparatus of claim 39, wherein the apparatus further comprises and elongate bar for connecting the leg curl/extension means to the support frame so as to limit movement of the leg curl/extension means toward the support frame.

49. The fold/extension exercise apparatus of claim 48, wherein the elongate bar is disposed such that applying force to the leg curl/extension means towards the support frame causes the leg curl/extension means to move generally upwardly and causes the seating means to move into the second, folded position.

50. The fold/extension exercise apparatus of claim 39, wherein the support frame has a generally horizontal base portion, a first generally vertical support column and a second generally vertical support column.

51. The fold/extension apparatus of claim 50, wherein the first generally vertical support column is attached to the pull-up/press means.

52. The fold/extension apparatus of claim 50, wherein the second generally vertical support column has an upper end and wherein the second generally vertical support column is attached to the seating means with a pivotable attachment at the upper end of the second generally vertical support column so as to enable the seating menas to pivot with respect to the second generally vertical support column.

53. The fold/extension apparatus of claim 52, wherein the pivotable attachment is lockable so as to limit pivoting of the second generally vertical support column relative to the seating means.

54. The fold/extension apparatus of claim 50, wherein the second generally vertical support column has a lower end and wherein the second generally vertical support column is attached to the base portion with a pivotable attachment at the lower end of the second generlly vertical support column so as to enable the second generally vertical support column to pivot with respect to the base portion.

55. The fold/extension apparatus of claim 54, wherein the pivotable attachment at the lower end of the second generally vertical support column is lockable so as to limit pivoting of the second generally vertical support column relative to the base portion.

56. The fold/extension apparatus of claim 50, wherein the base portion has a first portion and a second portion attached by a joint means to enable pivoting of the first portion into a generally vertical position.

57. The fold/extension apparatus of claim 50, wherein the apparatus further comprises a bracing handle disposed adjacent the seating means.

58. The fold/extension apparatus of claim 57, wherein the bracing handle is rotatably attached to the second generally vertical support column, and wherein the bracing handle includes a curved end positionable adjacent the lower portion of the seating means.

59. A fold/extension exercise apparatus comprising:

a seating means for seating a person, the seating means having an upper portion and a lower portion pivotably attached to one another, the seating means being pivotable between a first, extended position wherein upper and lower portions are pivoted away from each other and a second, folded position wherein the upper and lower portions are drawn towards one another;

pull-up/press means pivotably attached to the seating means and having a free end movable relative thereto between a first position away from the seating means and a second position adjacent the seating means, such that when the seating means is disposed in the first, extended position, the free end of the pull-up/press means is disposed in the first position extended away from the seating means and such that when the seating means is disposed in the second, folded position, the free end is disposed adjacent the seating means; and leg curl/extension means being movable between a first extended position and a second, folded position, the leg curl/extension means being attached to the seating means such that movement of the seating means between the first, extended position and the second, folded position moves the leg curl/extension means between the first, extended position and the second, folded position, and vice-versa.

60. The fold/extension exercise apparatus of claim 59, wherein the apparatus further comprises resistance means for resisting movement of the pull-up/press means, the seating means and the leg curl/extension means between their first and second positions.

61. The fold/extension exercise apparatus of claim 59, further comprising a support frame having an attachment with the seating means, and attachment with the pull-up/press means and attachment with the leg curl/extension means, each attachment being independent of the other attachments.

62. The fold/extension exercise apparatus of claim 61, wherein the support frame is pivotably attached to the seating means, is pivotably attached to the pull-up/press means, and is pivotably attached to the leg curl/extension means.

63. The fold/extension exercise apparatus of claim 61, wherein the support frame comprises a base portion, a first generally vertical support column attached to the pull-up/pres means, and a second generally vertical support column attached to the seating means.

64. The fold/extension exercise apparatus of claim 63, wherein the second generally vertical support column is pivotably connected to the seating means, and wherein said second generally vertical support is attached to the leg curl/extension means.

65. The fold/extension exercise apparatus of claim 63, wherein the second generally vertical support column is pivotably attached to the base portion so as to enable the second generally vertical support column to pivot with respect to said base portion.

66. The fold/extension exercise apparatus of claim 63, wherein the apparatus further comprises a bracing handle connected to the second generally vertical support column, said bracing handle having an end extending upwardly to a position adjacent the seating means.

67. The fold/extension exercise apparatus of claim 59, wherein the apparatus further comprises resistance means for resisting movement between the first, extended position and the second folded position.

68. A fold/extension exercise apparatus comprising:

a support frame a seating means for seating a person, the seating means having an upper portion and a lower portion pivotably attached to one another, the seating means being pivotable between a first, extended position wherein upper and lower portions are pivoted away from each other and a second, folded position wherein the upper and lower portions are drawn towards one another, the seating means also being pivotably attached to the support frame;

pull/press means attached to the upport frame and the seating means such that moving the pull/press means into a first, extended position causes movement of the seating means into the first, extended position, and release of the pull/press means allows movement of the seating means into the second, folded position; and leg curl/extension means connected to the seating means, the leg curl/extension means being movable between a first extended position and a second, folded position.

69. The fold/extension exercise apparatus of claim 68, wherein the pull/press means comprises a cable attached to the support frame at a first end thereof, and to a handle at an opposing second end thereof.

70. The fold/extension exercise apparatus of claim 69, wherein the seating means has a wheel attached thereto, the cable being looped about said wheel such that pulling the second end of the cable moves the upper portion of the seat toward the support frame, thereby moving the seating menas into the first, extended position.

* * * * *